US007025553B1

(12) United States Patent
Thomas et al.

(10) Patent No.: US 7,025,553 B1
(45) Date of Patent: Apr. 11, 2006

(54) DREDGING VESSEL AND METHOD FOR RECOVERING, TRANSPORTING AND OFF LOADING MATERIAL

(75) Inventors: Dennis R. Thomas, Peoria, IL (US); Michael D. Platt, 2034 Knox Rd., 700 North, Yates City, IL (US) 61572; Edward S. Kress, Brimfield, IL (US)

(73) Assignee: Michael D. Platt, Yates City, IL (US)

( * ) Notice: Subject to any disclaimer, the term of this patent is extended or adjusted under 35 U.S.C. 154(b) by 0 days.

(21) Appl. No.: 09/486,280

(22) PCT Filed: Jul. 28, 1999

(86) PCT No.: PCT/US99/16972

§ 371 (c)(1),
(2), (4) Date: Feb. 24, 2000

(87) PCT Pub. No.: WO00/06838

PCT Pub. Date: Feb. 10, 2000

Related U.S. Application Data

(60) Provisional application No. 60/102,654, filed on Oct. 1, 1998, provisional application No. 60/098,160, filed on Aug. 27, 1998, provisional application No. 60/095,797, filed on Aug. 7, 1998, provisional application No. 60/094,633, filed on Jul. 30, 1998, and provisional application No. 60/094,378, filed on Jul. 28, 1998.

(51) Int. Cl.
*B63B 35/30* (2006.01)

(52) U.S. Cl. ..... 414/137.7; 37/338; 414/137.8; 414/137.9; 414/138.7; 414/139.3; 414/142.1; 414/142.3

(58) Field of Classification Search ..... 37/317, 37/338; 414/137.7, 137.8, 137.9, 138.7, 138.9, 414/139.1, 139.3, 140.8, 140.9, 142.1, 142.2, 414/142.3

See application file for complete search history.

(56) References Cited

U.S. PATENT DOCUMENTS

| | | | |
|---|---|---|---|
| 808,800 | A | 1/1906 | Wright |
| 1,153,851 | A | 9/1915 | Menzies |
| 1,196,426 | A | 8/1916 | Bowling |

(Continued)

FOREIGN PATENT DOCUMENTS

| | | |
|---|---|---|
| FR | 2 580 693 | 10/1986 |
| GB | 1 538 389 | 1/1979 |
| JP | 56039988 | 4/1981 |

(Continued)

OTHER PUBLICATIONS

Full English Translation of Okawa et al., Japanese Patent No. JP 04106228A, Publication Date Apr. 8, 1992.
Full English Translation of Omiya et al., Japanese Patent No. JP 410018345A, Publication Date Jan. 20, 1998.

(Continued)

*Primary Examiner*—Janice L. Krizek
(74) *Attorney, Agent, or Firm*—Husch & Eppenberger, LLC; Robert C. Haldiman

(57) ABSTRACT

A multi-purpose vessel for use when recovering material from a bottom surface of a body of water. The vessel includes a hull and a dredge assembly mounted to the hull. The dredge assembly is adapted to recover the material from the bottom surface. A conveyor system is provided, with the conveyor system including a first portion adapted to receive the material from the dredge assembly, a moveable second portion, and a distribution portion. The second portion is moveable to a first position in which the second portion is adapted to receive the material from the first portion and to convey the material to a first desired location disposed a first distance away from the hull. The second portion is further moveable to a second position in which the second portion is adapted to convey the material to the distribution portion. The distribution portion is adapted to convey the material a second distance greater than the first distance away from the hull.

31 Claims, 19 Drawing Sheets

U.S. PATENT DOCUMENTS

| | | | | |
|---|---|---|---|---|
| 1,249,555 | A | | 12/1917 | Townsend |
| 1,460,558 | A | | 7/1923 | Olden |
| 1,839,929 | A | | 1/1932 | Powell |
| 2,309,715 | A | | 2/1943 | Rudow |
| 2,731,741 | A | | 1/1956 | Kaufmann ..... 37/54 |
| 3,086,305 | A | | 4/1963 | West ..... 37/73 |
| 3,313,051 | A | | 4/1967 | Sova ..... 37/189 |
| 3,476,498 | A | | 11/1969 | Bolhar ..... 299/8 |
| 3,578,186 | A | | 5/1971 | Thomas |
| 3,640,238 | A | | 2/1972 | Stockdale ..... 114/235 A |
| 3,650,238 | A | | 3/1972 | Stockdale ..... 114/235 R |
| 3,690,023 | A | | 9/1972 | Peterson ..... 37/90 |
| 3,782,317 | A | | 1/1974 | Kriedt et al. ..... 114/52 |
| 3,783,626 | A | | 1/1974 | Hansen ..... 61/46.5 |
| 3,845,631 | A | | 11/1974 | Malan ..... 61/30 |
| 4,070,978 | A | | 1/1978 | Virgilio ..... 114/26 |
| 4,162,584 | A | | 7/1979 | Satterwhite ..... 37/190 |
| 4,214,387 | A | | 7/1980 | Boehme et al. ..... 37/195 |
| 4,257,178 | A | | 3/1981 | Spradlin ..... 37/70 |
| 4,397,587 | A | | 8/1983 | Op den Velde et al. .... 405/222 |
| 4,412,587 | A | | 11/1983 | van der Lely ..... 172/39 |
| 4,483,655 | A | | 11/1984 | Snow et al. |
| 4,592,155 | A | | 6/1986 | Mustonen ..... 37/54 |
| 4,702,023 | A | | 10/1987 | McDowen ..... 37/66 |
| 4,713,896 | A | | 12/1987 | Jennens ..... 37/54 |
| 5,049,021 | A | | 9/1991 | Pole et al. ..... 414/141.9 |
| 5,058,294 | A | | 10/1991 | Bryan, Jr. ..... 37/190 |
| 5,115,751 | A | | 5/1992 | Copson ..... 114/27 |
| 5,259,130 | A | * | 11/1993 | Rohr ..... 37/338 |
| 5,311,682 | A | | 5/1994 | Sturdivant ..... 37/312 |
| 5,404,696 | A | | 4/1995 | Vasby ..... 56/9 |
| 5,456,551 | A | | 10/1995 | Saxon ..... 405/163 |
| 5,479,869 | A | | 1/1996 | Coudon et al. ..... 114/26 |
| 5,490,339 | A | | 2/1996 | Accettola ..... 37/94 |
| 5,573,363 | A | * | 11/1996 | Rohr ..... 414/138.9 |
| 5,638,620 | A | | 6/1997 | Van Der Kooy ..... 37/338 |
| 5,642,684 | A | | 7/1997 | Aker ..... 114/151 |
| 5,853,264 | A | | 12/1998 | Treveloni ..... 405/17 |
| 5,903,989 | A | | 5/1999 | Satzler ..... 37/353 |
| 5,907,915 | A | | 6/1999 | Satzler ..... 37/337 |
| 5,960,570 | A | | 10/1999 | Satzler ..... 37/337 |
| 6,343,559 | B1 | * | 2/2002 | Thomas ..... 114/27 |
| 6,497,535 | B1 | * | 12/2002 | Thomas ..... 405/222 |

FOREIGN PATENT DOCUMENTS

| | | |
|---|---|---|
| JP | 61053921 | 3/1986 |
| JP | 62004695 | 1/1987 |
| JP | 04106228 | 4/1992 |
| JP | 05339930 | 12/1993 |
| JP | 10018345 | 1/1998 |
| WO | WO 95/21303 | 8/1995 |
| WO | WO 98/44204 | 10/1998 |

OTHER PUBLICATIONS

Full English Translation of Akio, Japanese Patent No. JP 61–53921, Publication Date Mar. 18, 1986.

*International Search Report* concerning International Application Serial No. PCT/US99/16972, European Patent Office, dated Nov. 4, 1998, 8 pages.

*Written Opinion* concerning International Application Serial No. PCT/US99/16972, European Patent Office, dated May 22, 2000, 9 pages.

* cited by examiner 198
210
212
211
208
194
192
204
196
188
216
218
214
202
200
205
176
172
144
174
162
180
170
159
142
140
150
159
130
160
196
162
138
206
172c
172
224
172b
222
220
172a
14
165
163
162
164
163a
170
173
165
171
116

198
132
204
192
205
202
200
218
216
214
172c
144
130
172
172a
172b
160
165
162
163
170
173
158
159
146
142
208
194
206
203
138
176
174
178
180
17
226
224
222
220
164
163a
171
171a

DREDGING VESSEL AND METHOD FOR RECOVERING, TRANSPORTING AND OFF LOADING MATERIAL

This application claims the benefit of Provisional Application Nos. 60/094,378, filed Jul. 28, 1998; 60/094,633, filed Jul. 30, 1998; 60/095,797, filed Aug. 7, 1998; 60/098,160, filed Aug. 27, 1998, and 60/802,654, filed Oct. 1, 1998.

FIELD OF THE INVENTION

The invention relates generally to dredging, and, more particularly, to a multi-purpose vessel and method for recovering, storing and/or transporting, and off-loading material in a dredging operation.

BACKGROUND OF THE INVENTION

Due largely to erosion, the waterways of many areas of the world are becoming choked with silt and the like. As the waterways become more and more shallow, certain problems arise. For example, navigation through the waterways becomes difficult or altogether impossible. In addition, the risk of flooding adjoining areas of a waterway increases as the depth of the waterway decreases.

Over the years, many dredging techniques have been devised. Perhaps the most popular dredging technique involves a vacuuming dredge which sucks silt and the like from the bottom of the waterway through a conduit or a hose. This technique is disadvantageous in several respects. For example, it collects large volumes of water in the dredging process. As a result, the material recovered by this dredging technique is largely a liquid mixture that is difficult to handle and dispose of. By way of another example, the vacuuming technique mentioned above tends to disturb the bed of the waterway in a manner that mixes silt and impurities imbedded in the silk into the water. Some of these impurities may be toxic (e.g., lead and mercury). Dredging with this old technique can, therefore, pose an environmental hazard. Due to these and other difficulties, dredging a waterway using the vacuuming technique is an expensive, time-consuming and hazardous proposition Recently, Caterpillar® has invented a new dredging assembly. The dredging assembly is a large wheel that rolls along and slices into the bed of a waterway. The wheel is compartmentalized by slicing blades that slice and pick-up segments of the bed of the waterway as the wheel turns in a fashion similar to a cookie cutter slicing cookies from dough. The development of this new dredging technology has made it possible to dredge waterways in a much more efficient, cost-effective manner. Specifically, because the dredging wheel lifts large segments of silt from the waterway bed, the material it recovers is largely solid and undisturbed, is not mixed with much (if any) additional water during dredging, and, thus, can be more efficiently handled than material recovered by the prior art vacuuming system discussed above.

While the development of the Caterpillar® dredging wheel offers a significant opportunity to recover material from the waterways of the world and to restore those waterways to navigable depths, it has also given rise to a new set of technological problems from the material handling perspective. Specifically, now that it is possible to quickly dredge large volumes of substantially solid material from a waterway, it is necessary to develop apparatus and systems for handling, transporting and/or disposing of the material recovered by the dredge.

SUMMARY OF THE INVENTION

In accordance with an aspect of the invention, a multi-purpose vessel for use when recovering material from a bottom surface of a body of water comprises a hull, a dredge assembly mounted to the hull, a hopper, and a transfer conveyor. The dredge assembly is adapted to recover the material from the bottom surface, and the hopper is supported by the hull and is adapted to receive the material. The transfer conveyor is adapted to receive the material from the dredge assembly, and is shiftable between a first position in which the transfer conveyor is operable to convey the material toward the hopper, and a second position in which the transfer conveyor is operable to convey the material off the vessel.

In further accordance with a preferred embodiment, the hull may be provided with a propulsion system, and the hopper may include a moveable floor adapted to move the material in the hopper. The moveable floor may include a slat conveyor, such as comprising a plurality of cleats attached to the moveable floor. The moveable floor may include a flexible belt mounted on a plurality of rollers, or the moveable floor may include an ejector blade moveably mounted within the hopper, with the ejector blade being adapted to move the material in the hopper.

The vessel preferably includes a distribution conveyor mounted to the hull. The distribution conveyor includes a first end and a second end, and a discharge conveyor may be provided having a portion extending into the hopper and being adapted to discharge the material from the hopper to the distribution conveyor adjacent the first end. The distribution conveyor second end is moveable to a desired position to thereby unload the material at a desired location. The distribution conveyor may include an extendable portion, such as by slidably mounting the extendable portion in a housing, and may include a rack and pinion assembly mounted to the housing and engaging the extendable portion for extending and retracting the extendable portion. Still preferably, the distribution conveyor is mounted on a turret assembly, and a rack and pinion assembly may be provided, which is arranged to rotate the distribution conveyor on the turret assembly.

Preferably, the transfer conveyor is moveably mounted to the hull, such as by mounting the transfer conveyor on a turret assembly. A rack and pinion may be provided which is arranged to rotate the transfer conveyor on the turret assembly.

The hopper may be generally rectangular, and preferably a discharge auger or other discharge assembly is mounted to the hull and includes a portion extending into the hopper to discharge the material from the hopper. The discharge assembly may include a pair of counter rotating augers, with each of the augers including a portion extending into the hopper.

The hull may be provided with a propulsion system for moving the hull through the water. The propulsion system may include a tractive element which is adapted to engage the bottom surface of the body of water. Preferably, the tractive element is moveably mounted to the hull and is shiftable between a retracted position in which the tractive element is disposed toward the hull and an extended position in which the tractive element engages the bottom surface. The propulsion system may also include a plurality of positioning jets.

Preferably, the distribution conveyor is provided with a moveable counterweight. The counterweight is positionable relative to the distribution conveyor so as to counteract the forces applied to the distribution conveyor by the material.

In accordance with another aspect of the invention, a multi-purpose vessel for use when recovering material from a bottom surface of a body of water comprises a hull, with a dredge assembly being mounted to the hull. The dredge assembly is adapted to recover the material from the bottom surface. A conveyor system is provided, with the conveyor system including a first portion adapted to receive the material from the dredge assembly, a moveable second portion, and a distribution conveyor. The second portion is moveable to a first position in which the second portion is adapted to receive the material from the first portion and to convey the material to a first desired location disposed a first distance away from the hull. The second portion is further moveable to a second position in which the second portion is adapted to convey the material to the distribution conveyor. The distribution conveyor is adapted to convey the material a second distance greater than the first distance away from the hull.

In accordance with a still further aspect of the invention, a multi-purpose vessel for use on a body of water vessel comprises a hull, a dredge assembly mounted to the hull, with the dredge assembly being adapted to recover material from a bottom surface of the body of water, a hopper supported by the hull, with the hopper being adapted to receive the material, and a conveyor system. The conveyor system includes a first portion adapted to receive the material from the dredge assembly, and further includes a moveable second portion adapted to receive the material from the first portion and to convey the material along a plurality of desired paths. A first of the desired paths being away from the hull and a second of the desired paths being toward the hopper.

In accordance with yet another aspect of the invention, a method of conveying material recovered in a dredging operation to a desired location comprises the steps of positioning a water-borne vessel having a dredge assembly and a distribution conveyor at a first position in a waterway, recovering the dredged material from the waterway and conveying the material to a first end of the distribution conveyor, positioning a second end of the distribution conveyor at a desired location, and conveying the material along the distribution conveyor to the second end for deposition therefrom as the vessel proceeds along the waterway.

In accordance with another aspect of the invention, a method of forming a working channel in a silt-laden waterway comprises the steps of moving a water-borne vessel having a dredge assembly and a distribution conveyor through the waterway, recovering the silt material from the waterway and conveying the silt material to a first end of the distribution conveyor, positioning a second end of the distribution conveyor at a desired location, and conveying the material along the distribution conveyor to the second end for deposition therefrom as the vessel proceeds along the waterway.

In accordance with a further aspect of the invention, a method of forming an emergency levee in a waterway comprises the steps of moving a water-borne vessel having a dredge assembly and a distribution conveyor through the waterway, recovering the material from a bottom surface of the waterway and conveying the silt material to a first end of the distribution conveyor, positioning a second end of the distribution conveyor at a desired levee location, and conveying the material along the distribution conveyor to the second end for deposition therefrom as the vessel proceeds along the waterway.

In accordance with yet a further aspect of the invention, a method of repairing a breach in a levee comprises the steps of moving a water-borne vessel having a dredge assembly and a distribution conveyor through a waterway adjacent the levee, recovering material from a bottom surface of the waterway and conveying the material to a first end of the distribution conveyor, positioning a second end of the distribution conveyor at a desired location adjacent the breach, and conveying the material along the distribution conveyor to the second end for deposition therefrom as the vessel proceeds along the waterway.

Other features and advantages are inherent in the disclosed apparatus or will become apparent to those skilled in the art from the following detailed description and its accompanying drawings.

DESCRIPTION OF THE PREFERRED EMBODIMENTS

Figure 1:
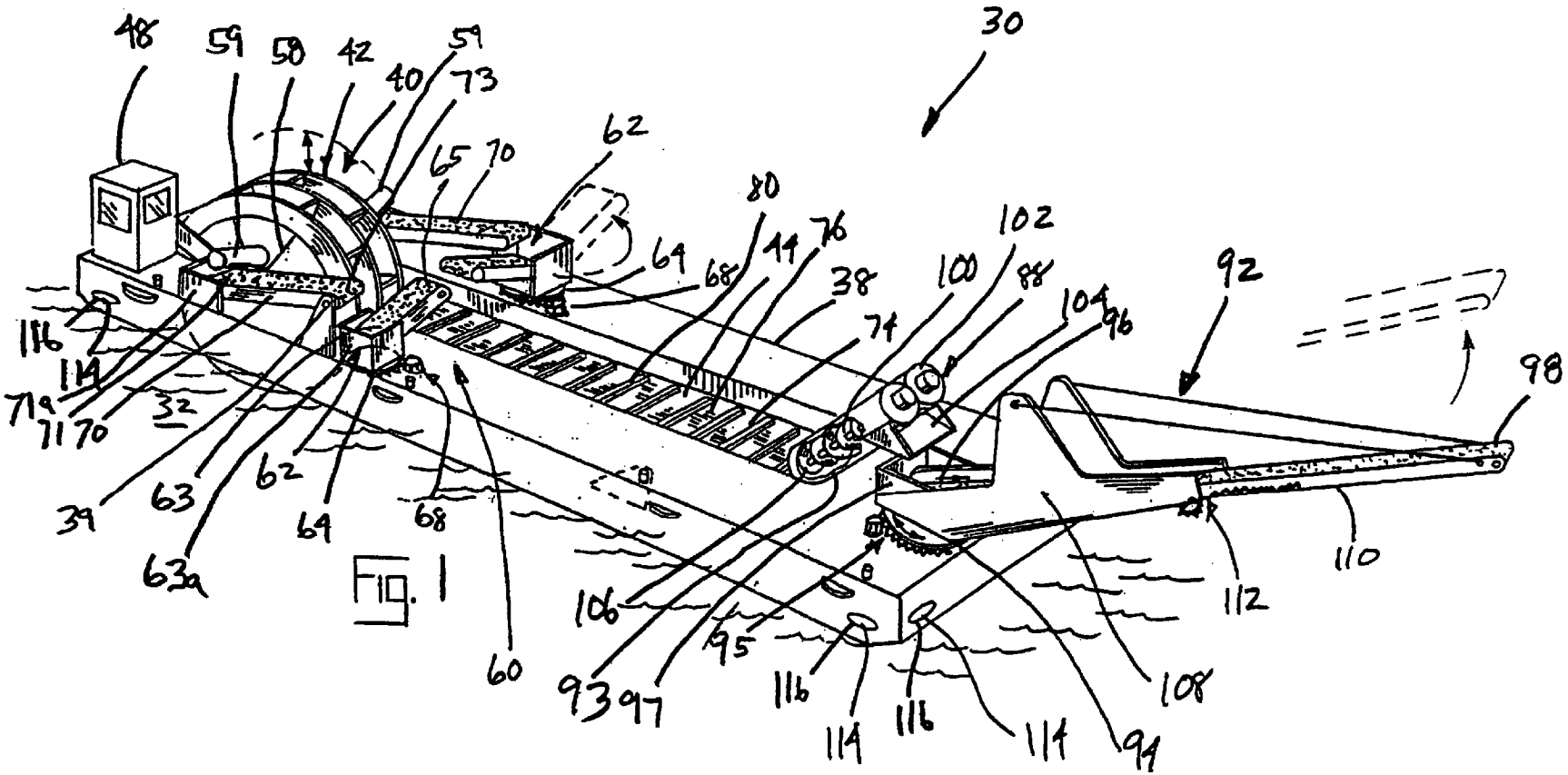
FIG. 1 is a perspective view of a multi-purpose vessel for use in a dredging operation which has been constructed in accordance with the teachings of the present invention.

The following description of the preferred embodiments is not intended to limit the scope of the invention to the precise forms disclosed, but instead is intended to be illustrative of the principles of the invention so that others may follow its teachings.

Referring now to FIGS. 1 through 11 of the drawings, an exemplary water-borne multi-purpose vessel constructed in accordance with the teachings of the present invention is generally referred to by the reference numeral 30 and is shown afloat on a body of water 32 having a bottom surface 34 (viewable in FIGS. 4 and 7–9), which bottom surface may have deposited thereon a layer of silt material 36. The vessel 30 includes a hull 38 to which is mounted a dredge assembly 40. The hull 38 is designed with a low draft for operation in shallow water. Preferably, the dredge assembly 40 mounted to the hull 38 is a dredge wheel 42 developed by Caterpillar®, which dredge wheel 42 is shown in greater detail in FIGS. 7–9. The Caterpillar® dredge wheel 42 may be used to rapidly dredge large amounts of the material 36 from the bottom surface 34 of a waterway, such as rivers, lakes, etc. A further description of an exemplary dredge wheel 42 will be provided in greater detail below.

A hopper 44 and a conveyor system 60 are also mounted to the hull. As shown to advantage in FIGS. 1–3 and 10, the hopper 44 is preferably rectangular in shape and is preferably substantially centered with respect to the hull 38 and extends substantially along the length thereof. Persons of ordinary skill in the art will readily appreciate that hoppers of other shapes, sizes and locations can be utilized without departing from the scope or spirit of the invention. In any event, the size of the hopper 44 is preferably selected along with the hull dimensions to provide a desired payload capacity. The hull 38 is powered by a propulsion system (not shown) which is controlled by an operator located in a cab 48 in a conventional manner. The dredge wheel 42 is located in a well or aperture 50 (FIGS. 3, 8 and 9) which is formed generally centrally relative to the hull 38. The dredge wheel 42 is supported by hydraulic jacks 43 (See FIGS. 8 and 9) or the like which can be powered to raise or lower the dredge wheel 42 to a desired depth for dredging or transport.

Figure 7:
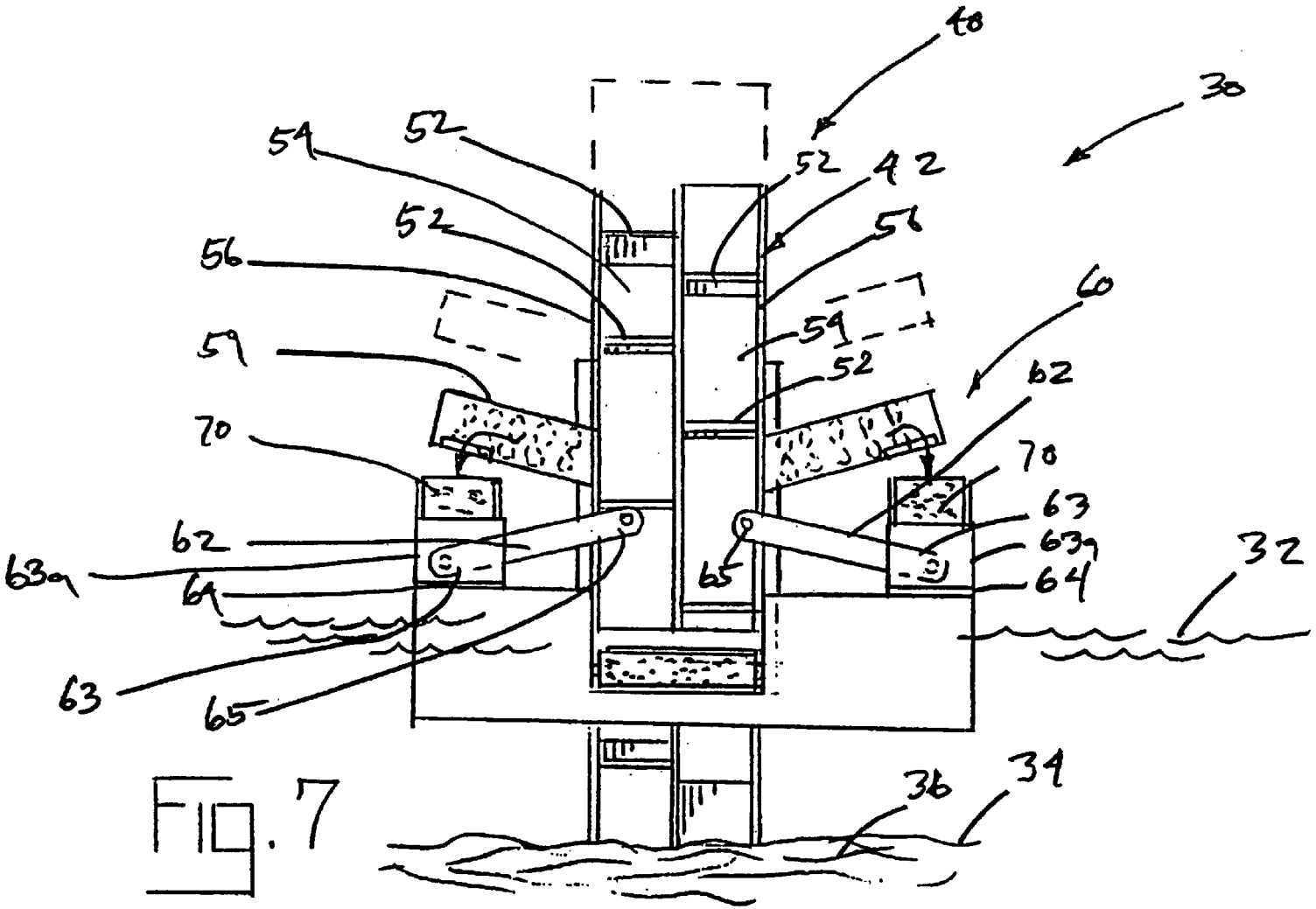
FIG. 7 is a bow end elevational view of the vessel of FIG. 1 providing an end view of the dredging assembly.
Figures 8, 9:
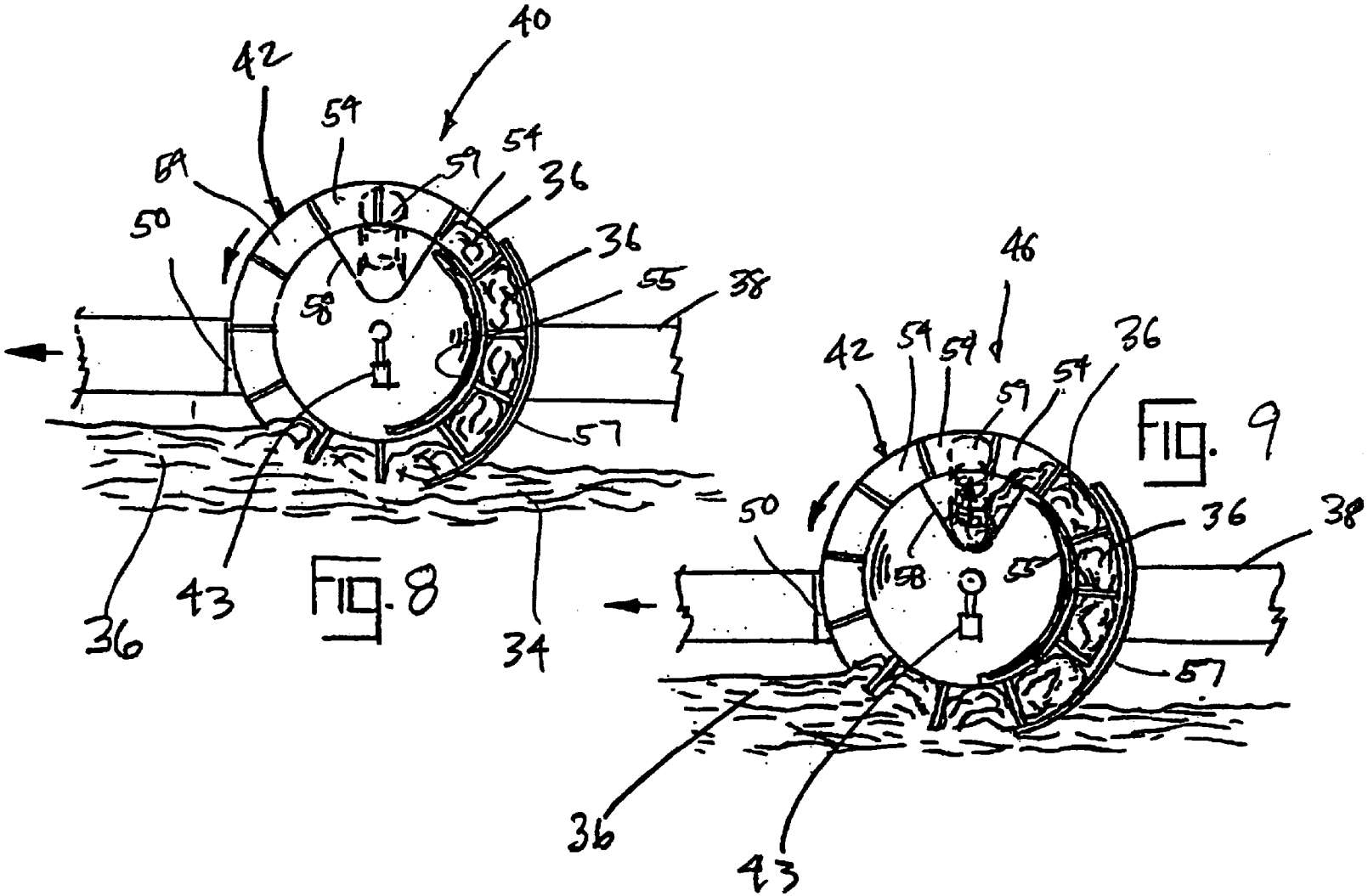
FIG. 8 is a fragmentary cross-sectional view taken along line 8—8 of FIG. 7 and illustrating the manner of operation of one possible dredge assembly for use on the vessel of FIG. 1.
FIG. 9 is a fragmentary cross-sectional view similar to FIG. 9 and illustrating recovered material exiting the dredge wheel and being deposited into a collection trough.

Referring now to FIGS. 7–9, for the purpose of capturing the recovered material 36 to be dredged from the bed or bottom surface 34 of the waterway, the dredge wheel 42 is provided with a number of generally evenly spaced blades 52. The blades 52 divide the outer perimeter of the dredging wheel 42 into a plurality of capture cavities 54. Two of the blades 52 cooperate to form two, oppositely disposed sides of each capture cavity 54. The other two opposite sides of the cavities 54 are formed by generally parallel, circular wheel plates 56. The top and bottom (i.e., the radially outward and radially inward sides, respectively) of each capture cavity 54 are open.

In operation, as the vessel 30 moves forward (i.e., to the left when viewing FIGS. 8 and 9), the dredging wheel 42 rotates such that a capture cavity 54 digs into the waterway bottom and collects a slab of material 36 to be dredged (See FIGS. 8 and 9). As the wheel 42 continues to rotate, the filled capture cavity 54 rotates between an inner capture plate 55 and an outer capture plate 57 formed at the back of the wheel 42. The capture plates 55, 57 seal the radially inner and outer openings of the capture cavity 54 to ensure the recovered material 36 remains in the cavity 54 as the cavity 54 rotates toward the top of the wheel 42.

As the filled capture cavity 54 reaches the top of the wheel 42, the inner capture plate 55 terminates such that, when the filed cavity 54 reaches the top of the wheel 42, the dredged material 36 falls out of the capture cavity 54 under the influence of gravity (and, optionally, under the influence of a mechanical assist (not shown)) and into a hopper or trough 58 disposed toward the center of the wheel 42. As shown in FIGS. 1–3 and 5–7 , the trough 58 is serviced by two, oppositely disposed augers 59 which function independently to discharge the recovered material 36 from the trough 58. A more detailed description of the structure and function of an exemplary dredge wheel 42 may be found in Satzler, U.S. Pat. No. 5,903,989, Satzler, U.S. Pat. No. 5,907,915, and U.S. patent application Ser. No. 08/834,676, the entire disclosures of which are hereby incorporated by reference herein in their entirety.

Figure 2:
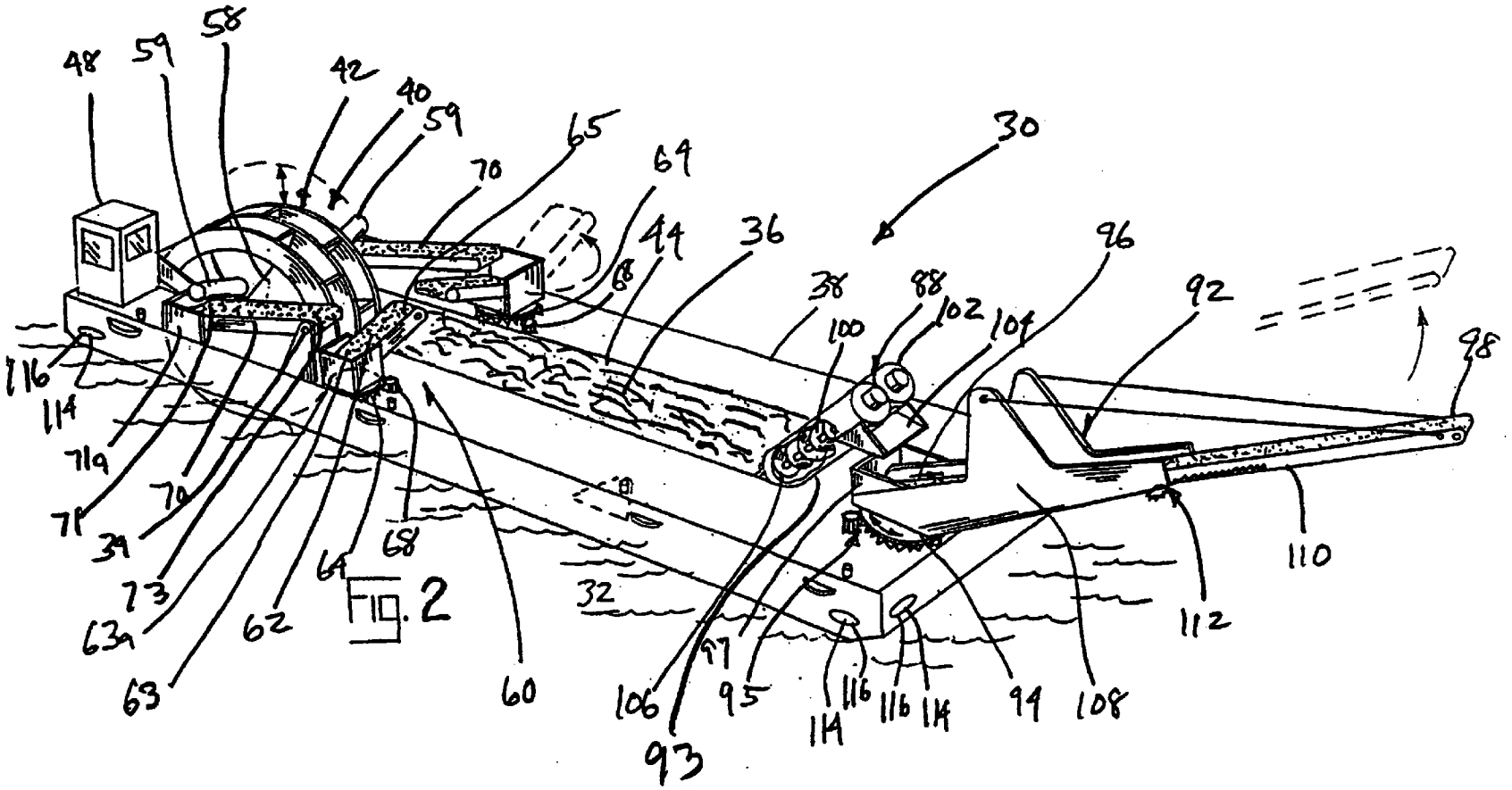
FIG. 2 is a perspective view of the vessel of FIG. 1 and illustrating the vessel in one possible state of operation in which the recovered material is being transferred to a nearly full hopper.
Figure 3:
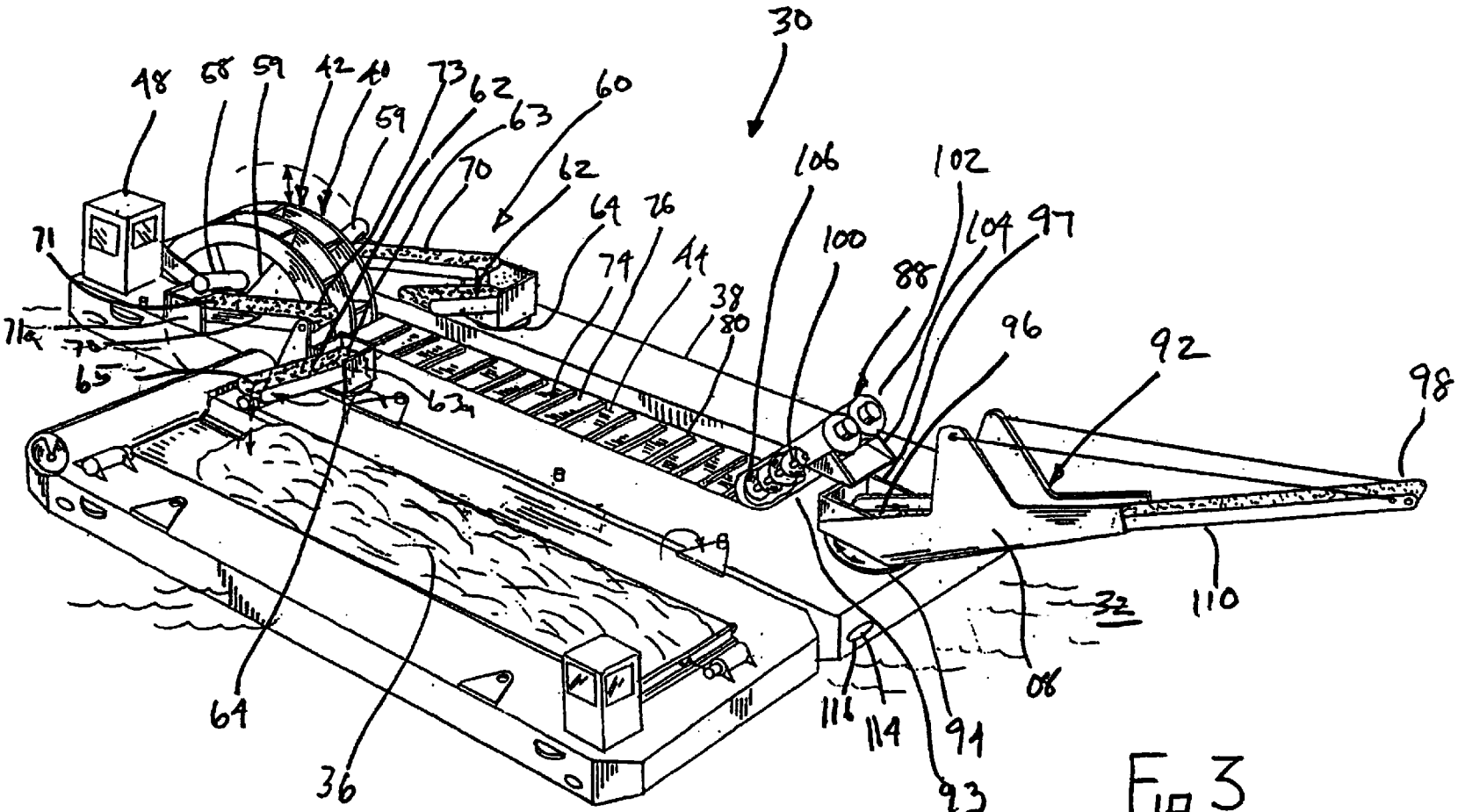
FIG. 3 is a perspective view of the vessel of FIG. 1 but illustrating the vessel in another possible state of operation in which the recovered material is being offloaded onto an adjacent transport vessel.
Figure 4:
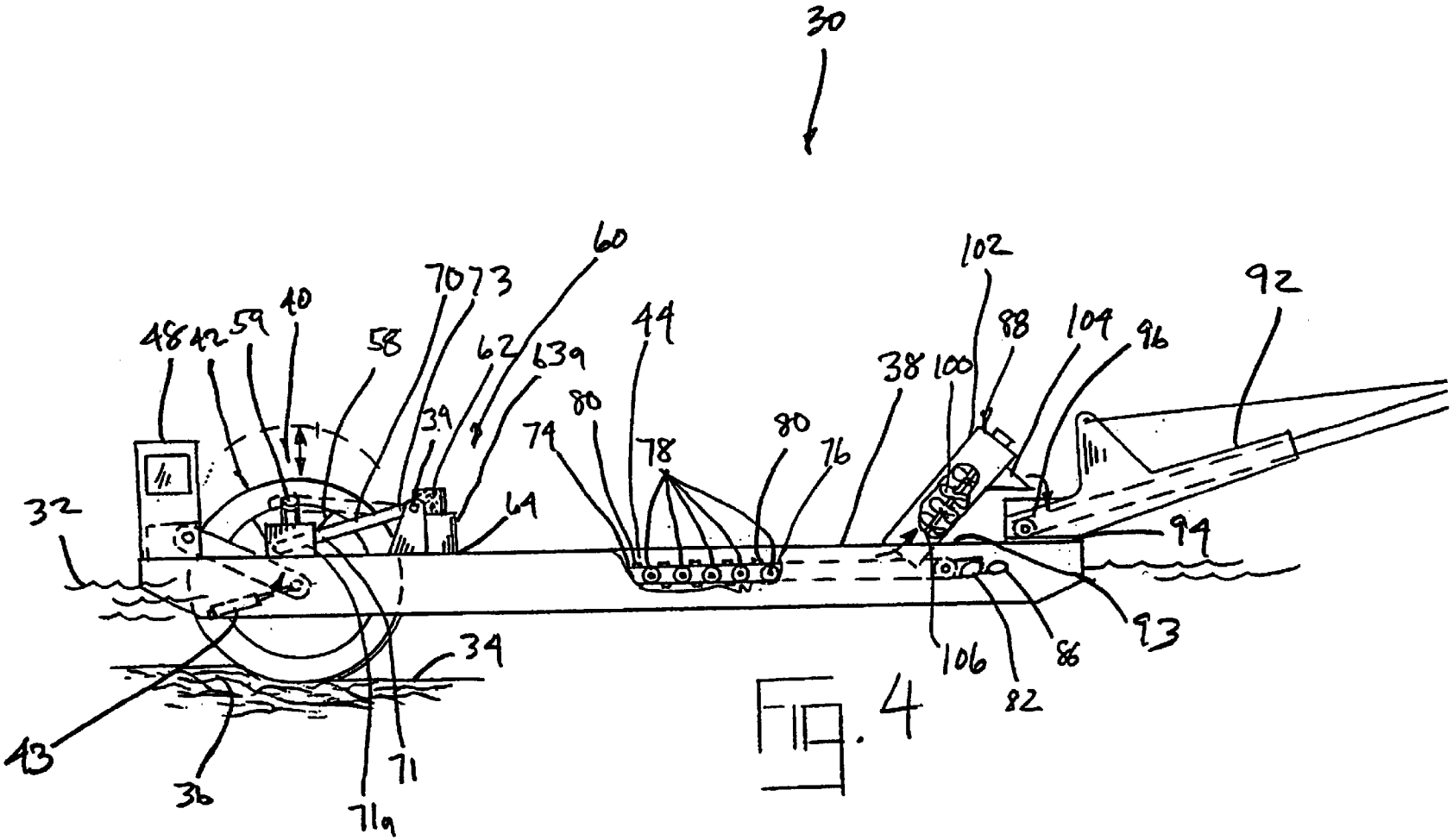
FIG. 4 is a right side elevational view, partly in section, of the vessel illustrated in FIG. 1.
Figure 5:
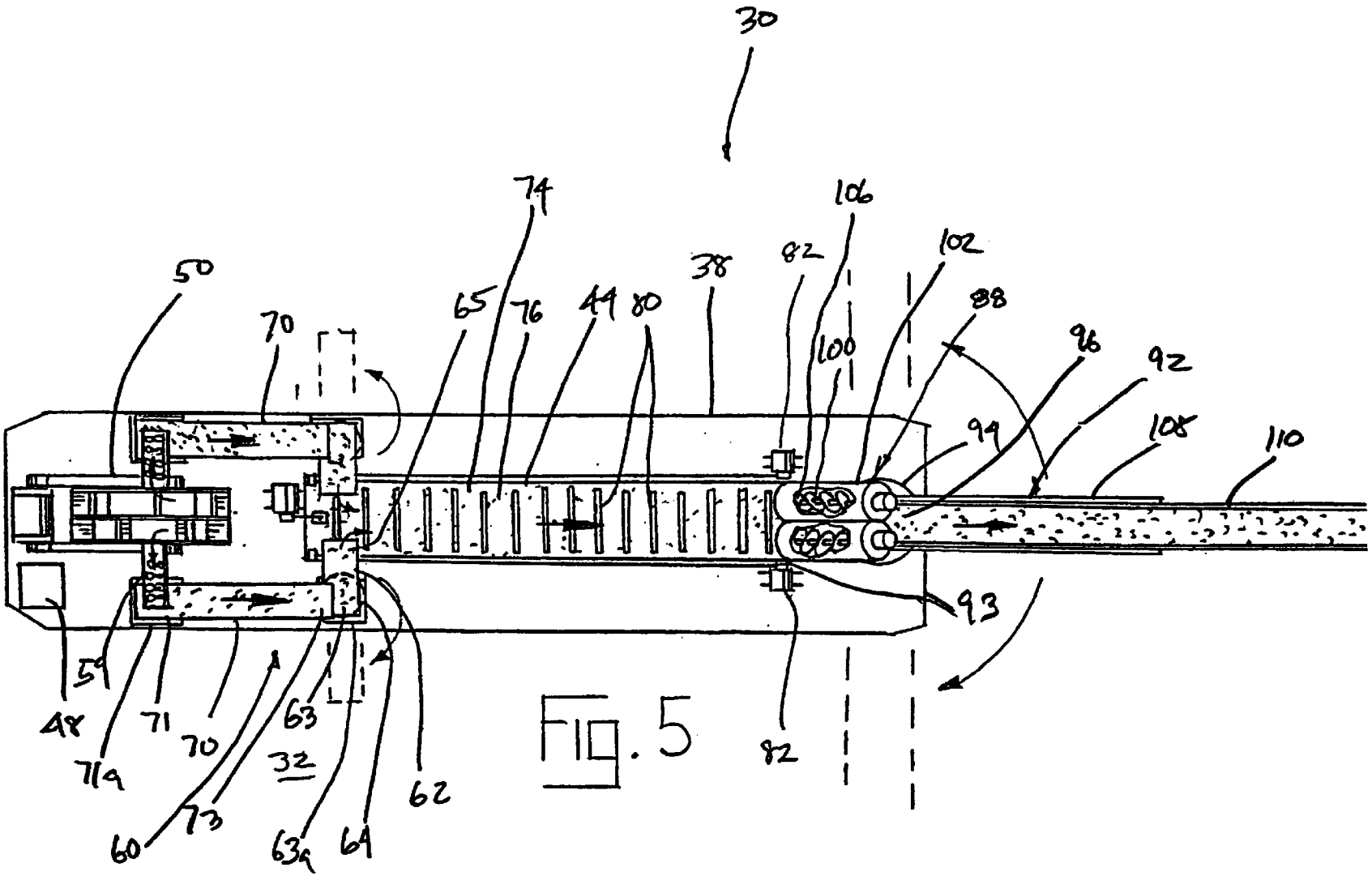
FIG. 5 is a top plan view of the vessel illustrated in FIG. 1.
Figure 6:
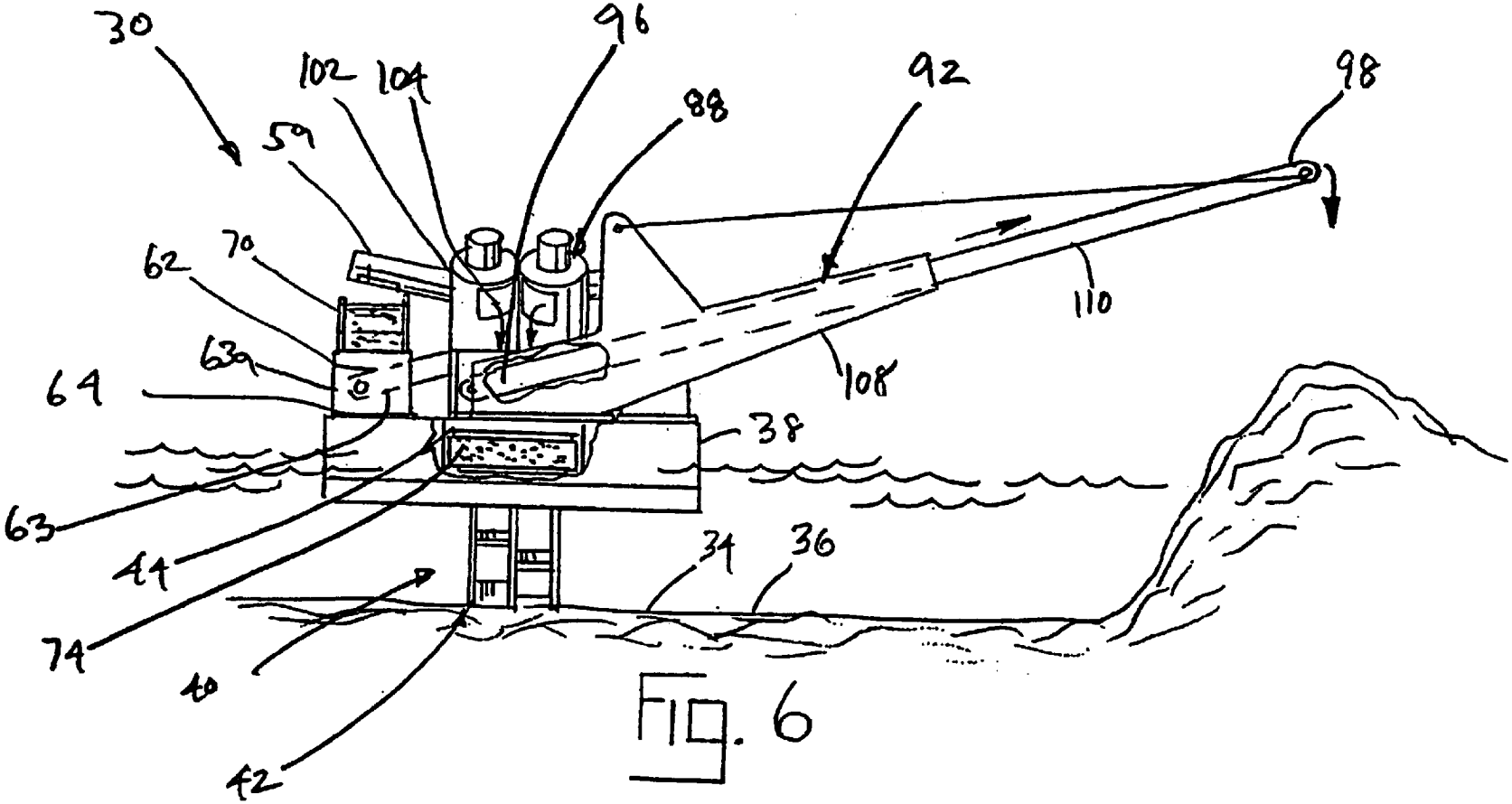
FIG. 6 is an stern end elevational view of the vessel illustrated in FIG. 1 but illustrating the vessel in yet another possible state of operation in which the recovered material is being offloaded at a desired location; the distribution conveyor is shown in a rotated or slewed position.

For the purpose of handling the material 36 recovered by the dredge assembly 40, the vessel 30 is further provided with a conveyor system 60. The conveyor system 60 may include a transfer conveyor 62, which is mounted on a turret 64 of conventional design. It will be understood that the vessel 30 is preferably provided with a pair of transfer conveyors 62, one on each side of the hull 38. The transfer conveyor 62 may be a rotatable belt conveyor, and includes a first end 63 and a second end 65. A receiving box 63*a* is provided adjacent the first end 63 in order to contain material 36 deposited thereon. A rack and pinion assembly 68 is provided, which enables the transfer conveyor to be rotated or pivoted between the position shown in FIG. 1, in which the second end 65 of the transfer conveyor is disposed over the hopper, and the position shown in FIG. 3, in which the second end 65 of the transfer conveyor 62 is disposed over an adjacent transport vessel. As shown in FIGS. 1–3, the transfer conveyor 62 is preferably upwardly inclined to facilitate loading into the hopper or the adjacent vessel. Note that as an alternatively, hydraulic cylinders may be employed in place of the rack and pinion assembly 68 in order to pivot the transfer conveyor 62 on the turret. Additional details concerning the structure and function of the adjacent transport vessel can be found in co-pending application Ser. No. 09/486,285, which is hereby incorporated by reference in its entirety.

Another conveyor 70 is disposed on the hull 38 generally adjacent to the dredge wheel 42, and includes a first end 71 having a receiving box 71*a*, and a second end 72 disposed generally adjacent to the first end 63 of the transfer conveyor 62. The receiving box 71 is disposed generally below the auger 59 so as to receive material 36 ejected thereby. The second end 73 of the conveyor 70 is pivotally mounted to the hull 38 by a pivot 39 (FIGS. 1–3), to accommodate upward and downward movement of the wheel 42 as the cylinders 43 raise and lower the wheel 42 to adjust the dredge assembly for different working depths.

Each turret 64 permits the corresponding receiving box 63*a* and transfer conveyor 62 to rotate approximately 180°. Persons of ordinary skill in the art will readily appreciate that both the turrets 64 and the belts of the conveyors 62, 70 can be driven in many ways without departing from the scope or spirit of the invention. By way of examples, not limitations, the conveyor belts and/or the turrets can be driven by electrical motors or hydraulic motors.

Figure 10:
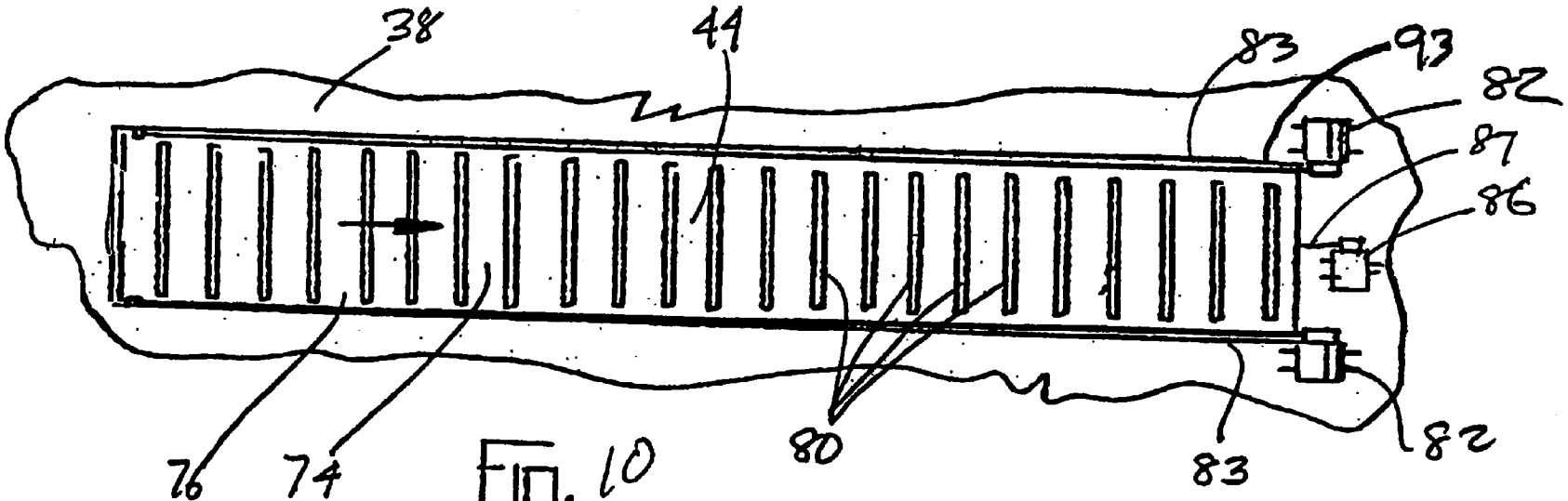
FIG. 10 is a top plan view of the hopper having a moveable floor.
Figure 11:
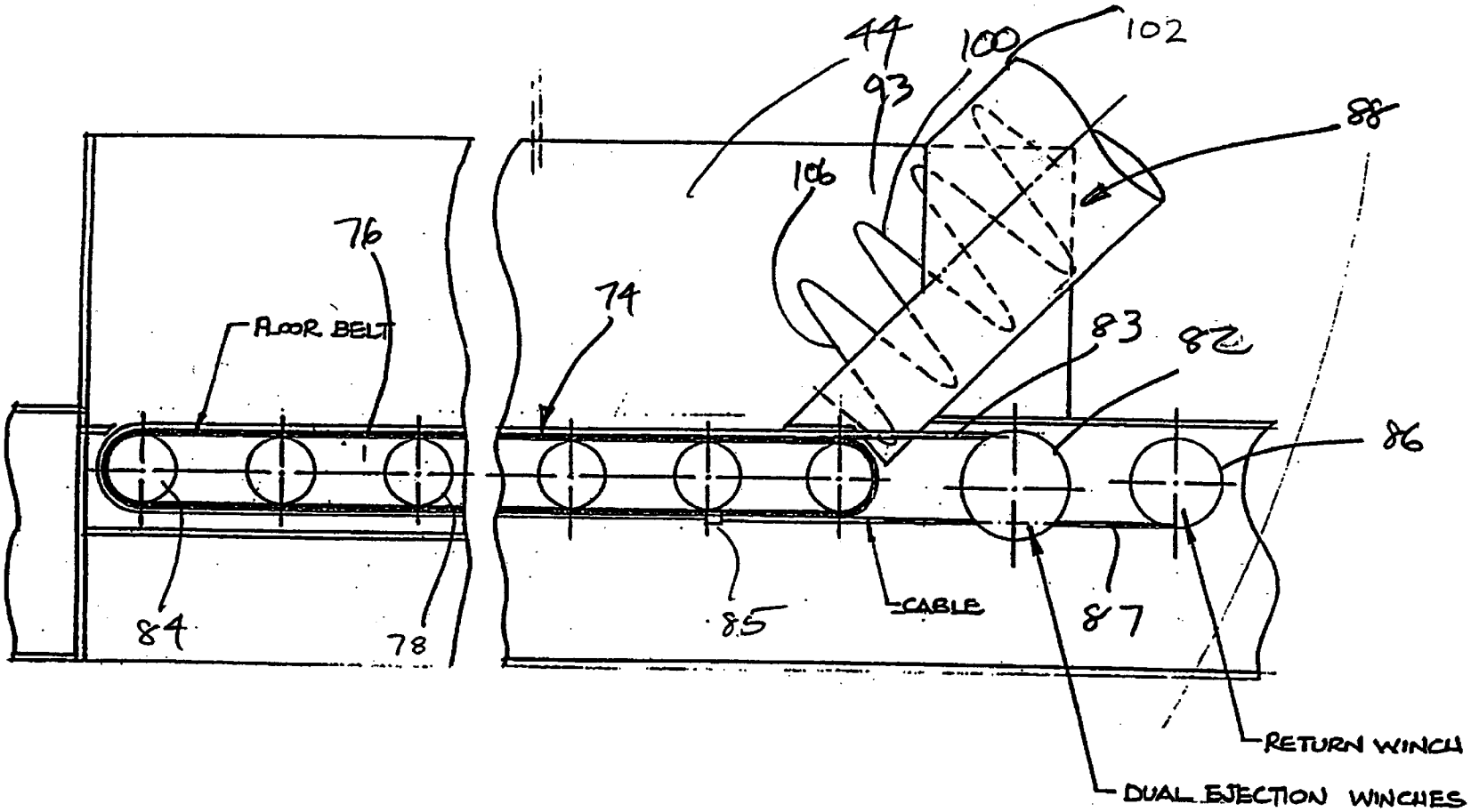
FIG. 11 is an enlarged, fragmentary side elevational view taken along line 11—11 of FIG. 10 showing the moveable floor and the ejection augers.

Referring now to FIGS. 10 and 11, the hopper 44 is provided with a movable floor 74. The movable floor 74 preferably extends over substantially the entire length and width of the hopper 44 and supports the material recovered in the dredging operation within the hopper 44. As most easily seen in FIG. 11, the movable floor 74 is preferably implemented by a conveyor belt 76 mounted upon a plurality of idler rollers 78 journalled between the side walls of the hopper 44. The idler rollers 78 are preferably mounted in low friction bearings (not shown) of conventional design and are closely spaced, but do not touch one another to minimize friction during movement of the floor 74.

The belt 76, which is preferably endless, is preferably implemented by commercially available conveyor belting material such as steel or nylon reinforced rubber. As shown in FIG. 10, the belt 76 is also preferably provided with steel cleats 80 to reduce, and preferably prevent, slippage between the moving floor 74 and the recovered material the floor supports as the material is being conveyed or moved by the floor 74.

The belt 76 is driven by a pair of ejection winches 82, which are operatively connected to a pair of cables 83 which extend along the top length of the belt 76, over an end roller 84, and back along the length of the belt 76 to an attachment point 85 (FIG. 11). A return winch 86 is provided, which also has a cable 87 secured to the attachment point 85. The arrangement of the winches 82, 86 and their associated cables 83, 87, respectively, makes possible a dual mode operation as follows. As material 36 is being deposited in the hopper 44 on the floor 74, the winches 82 gradually draw in their cables 83 and the winch 86 gradually lets out its cable 87. Thus, as the hopper 44 is loaded, the attachment point traverses the bottom of the hopper 44 (i.e., toward the left when viewing FIG. 11), to a point adjacent the end roller 84, at which point the hopper 44 is full of material 36. When it is desired to empty the hopper 44 (such as with the assistance of an ejection or discharge assembly 88 which will be described in greater detail below), the winches 82 continue to pull the belt 76 via the attachment point 85, such that the attachment point 85 travels up over the end roller 84, and traverses the hopper 44 again (i.e., this time to the right when viewing FIG. 11), as the discharge assembly 88 draws the material out of the hopper 44. When the hopper 44 is empty, the return winch 86 is used to reverse the motion of the belt 76.

Figure 12:
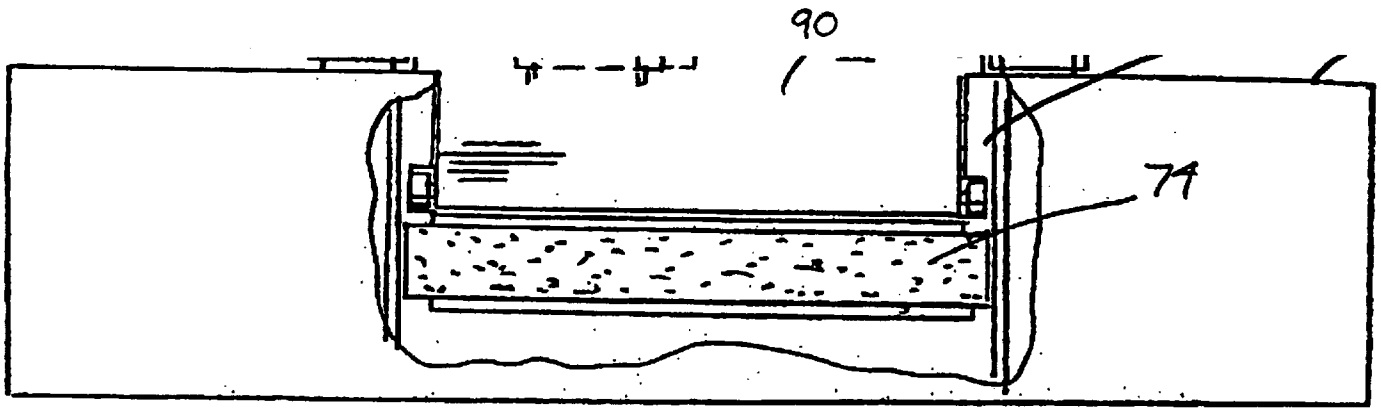
FIG. 12 is an enlarged fragmentary top plan view showing an alternative configuration for the hopper in which the slat conveyor floor of the hopper is supplemented by an ejector blade assembled in accordance with the teachings of the present invention.
Figure 13:
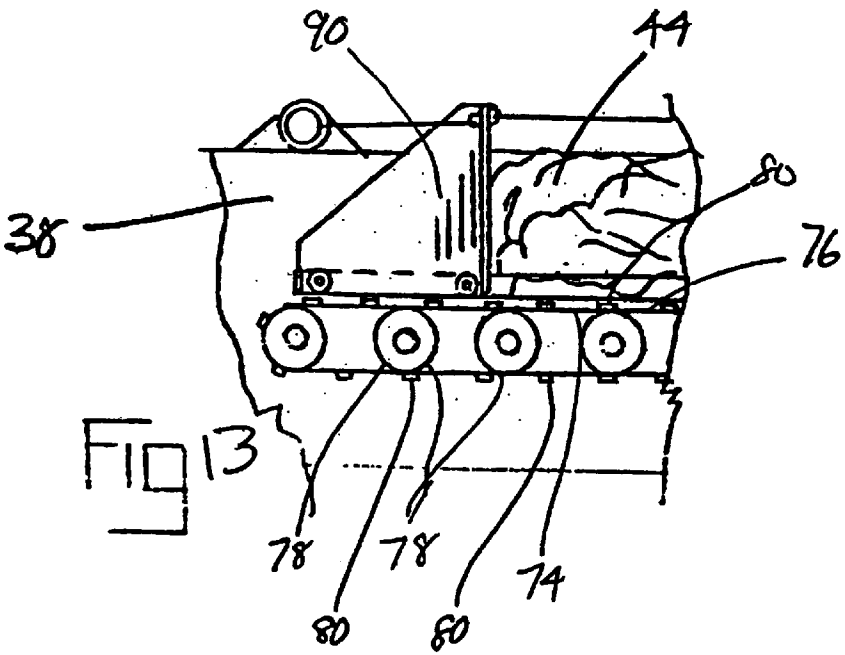
FIG. 13 is an enlarged fragmentary end view taken along line 13—13 of FIG. 12, partly in cut away, illustrating the ejector blade.

As an alternative, the hopper 44 may be equipped with an ejector blade 90 as shown in FIGS. 12 and 13. The ejector blade 90 is preferably mounted within a pair of guides defined in the sidewalls of the hopper 44 and secured to the belt 76. The structure and function of the ejector blade 90 is described more fully in the above-mentioned co-pending application Ser. No.09/486,285, which is hereby incorporated by reference in its entirety. Note that in the present application, and by way of example rather than limitation, the blade 90 may be de-coupled from the flexible belt 76, such that the above-described dual mode operation is still possible. The blade 90 may then be operable independently to assist in clearing the material 36 from the hopper 44.

Referring now to FIGS. 1–6, a distribution conveyor 92 is preferably a fixed length conveyor and is mounted to the hull 38 adjacent an end 93 of the hopper 44. The distribution conveyor 92 is preferably mounted to a turret 94 of conventional design, and is rotatable on the turret 94 by a rack and pinion assembly 95. The distribution conveyor 92 includes a first end 96 disposed in a receiving box 97, and further includes a second end 98. As shown for example in FIGS. 4, 5 or 6, the second end 98 can be placed at a desired location a substantial distance away from the hull 38, and can further be rotated or slowed by operation of the turret 94.

The discharge assembly 88 preferably includes a pair of counter-rotating augers 100, each of which is rotated by conventional electric or hydraulic motors as would be known. The augers 100 are disposed in a housing 102 having an ejection chute 104 generally adjacent to the receiving box 97. A bottom portion 106 of each auger 100 extends into the hopper 44, such that the material 36 may be extracted therefrom and conveyed through the housing 102 to the ejection chute 104, from where the material is conveyed to the first end 96 of the distribution conveyor 92 via the receiving box 97. The distribution conveyor 92 includes a flexible and rotatable belt and suitable drive motors, all of which are of conventional design and which are carried by a suitable support 108 mounted on the turret 94. The distance the second end 98 is disposed from the vessel 30 may typically be controlled simply by slewing the distribution conveyor 92 on its turret 94.

As shown in FIG. 1, the distribution conveyor 92 may optionally be extensible, such as by slidably mounting an extensible portion 110 in a suitable housing 111 defined in the support 108. A rack and pinion assembly 112 may be provided for extending and retracting the extensible portion 110.

In order to enhance the maneuverability of the vessel 30, the vessel 30 is further provided with stern and bow thrusters 114 on each of its sides as can be seen in each of FIGS. 1–3. The thrusters 114 are preferably implemented as low power water jets or impellers of conventional design. In other words, they are implemented by hydraulically or electrically driven impellers located in transverse tubes having preferably oval shaped outlet ports 116 to ensure the thrusters create a fan-shaped water stream (as opposed to a circular water jet which might be less effective than the fan-shaped jet in shallow water). A more detailed description of the thrusters may be found in co-pending application Ser. No. 09/486,285.

The vessel 30 is also provided with a rudder (not shown) of conventional design, which enhances the steerability provided by the side thrusters 114. Suitable engines (not shown) are provided for primary propulsion, preferably twin engines having suitably spaced, high pitch low diameter screws. The engines along with the side thrusters 114, the rudder and the various other systems of the vessel 30 are preferably controlled from a control panel located in the cab 48.

While as described above, twin engines 58 are preferred as the primary source of propulsion for the vessel 50, persons of ordinary skill in the art will appreciate that water jets could be used in place of the engines 58 without departing from the scope or spirit of the invention.

In operation, the vessel proceeds along under power in a direction generally to the upper left when viewing FIG. 1 As described above, the rotating dredge wheel 42 continually deposits recovered material 36 into the trough 58, from where the material 36 is extracted by the augers 59 and deposited into the receiving box 71*a* of the conveyor 70. The material is then conveyed from the first end 71 to the second end 73, from where it is deposited into the receiving box 63*a* of the transfer conveyor 62.

The transfer conveyor 62 enables the conveyor system 60 to operate in a number of modes. One such mode is shown in FIG. 3, in which an adjacent transport vessel of the type described above is disposed alongside the vessel 30 and secured thereto by a suitable docking pins and capture arms of the type described more fully in the above-mentioned co-pending patent application Ser. No. 09/486,285. By operation of the rack and pinion assembly 68, the transfer conveyor 62 maybe rotated on its turret 64 such that the second end 65 is disposed over the hopper of the adjacent vessel. According, the material 36 recovered by the dredge wheel 42 may be deposited along a path directly into the adjacent vessel for transport.

Another such operational mode is illustrated in FIG. 1, wherein the second end 65 of the conveyor 62 is positioned directly over the hopper 44 of the vessel 30. In this mode, the material may be directed along a path into the hopper 44. As the material 36 is deposited on the moveable floor 74, the winches 82 are activated such that the hopper 44 is gradually loaded as the moveable floor 74 carries the material 36 toward the discharge assembly 88. Further in this operational mode, once the hopper 44 is full it may be emptied by continuing to operate the winches 82. As the belt 76 proceeds as described above, the material 36 is conveyed toward the augers 100 of the discharge assembly 88, which augers 100 draw the material 36 from the hopper 44 and convey the material 36 to the receiving box 97 of the distribution conveyor 92 via the discharge chute 104. The material is then conveyed along the distribution conveyor 92 to the second end 98 thereof, from where the material is deposited at a desired location.

It will be understood that the vessel 30 may also load an adjacent vessel simultaneously with loading its own hopper 44, simply by independently positioning the transfer conveyors 62 on both sides of the vessel as required. It will also be understood that the vessel 30 may load the hopper 44 until full, cease dredging operations, and then travel to a designated location to deposit the material 36 (such as at a levee to be constructed, at an island to be constructed, or at a designated truck loading station if it is desired to haul the material 36 away). Other possible modes of operation will become readily apparent to those skilled in the art.

Referring now to FIGS. 14 through 21, a multi-purpose vessel constructed in accordance with the teachings of a second embodiment of the present invention is shown and is referred to by the reference numeral 130. To the extent possible, those elements that are the same or similar to the elements outlined above with respect to the first embodiment have the same or similar reference numerals, but increased by 100. The vessel 130 includes a hull 138, a dredge assembly 140, such as the same dredge wheel 142 construction, and a conveyor system 160. A trough 158 is disposed toward the center of the wheel 142, and is serviced by two, oppositely disposed augers 159 which function independently to discharge the recovered material 136 from the trough 158.

The conveyor system 160 includes first and second conveyors 170 and 172, as well as an intermediate transfer conveyor 162. The conveyor 170 includes a first end 171, a second end 173, and a receiving box 171*a*, while the second conveyor includes a receiving box 172*a* at a first end 172*b*, and further includes a second end 172*c*. The receiving boxes 171*a*, 172*a* work to contain the material 136 received at their respective ends. The conveyor system 160 also includes a transfer conveyor 162, which is mounted on a turret 164 of conventional design. Again, it will be understood that the vessel 130 is preferably provided with substantially similar conveyor systems 160 on both sides of the hull 138. The transfer conveyor 162 may be a rotatable belt conveyor, and includes a first end 163 and a second end 165. A receiving box 163*a* is provided adjacent the first end 163 in order to contain material 136 deposited thereon. A rack and pinion assembly 168 is provided, which enables the transfer conveyor 162 to be rotated or pivoted between the position shown in FIG. 14, in which the second end 165 of the transfer conveyor 162 is disposed over the receiving box 172*a* of the conveyor 172, to the position of FIG. 15 in which the second end 165 of the transfer conveyor 162 is disposed over the hopper 144, and to the position of FIG. 16 in which the second end 165 of the transfer conveyor is disposed over the hopper of an adjacent transport vessel. Again, each turret 164 permits the corresponding receiving box 163*a* and transfer conveyor 162 to rotate approximately 180°.

Figure 14:
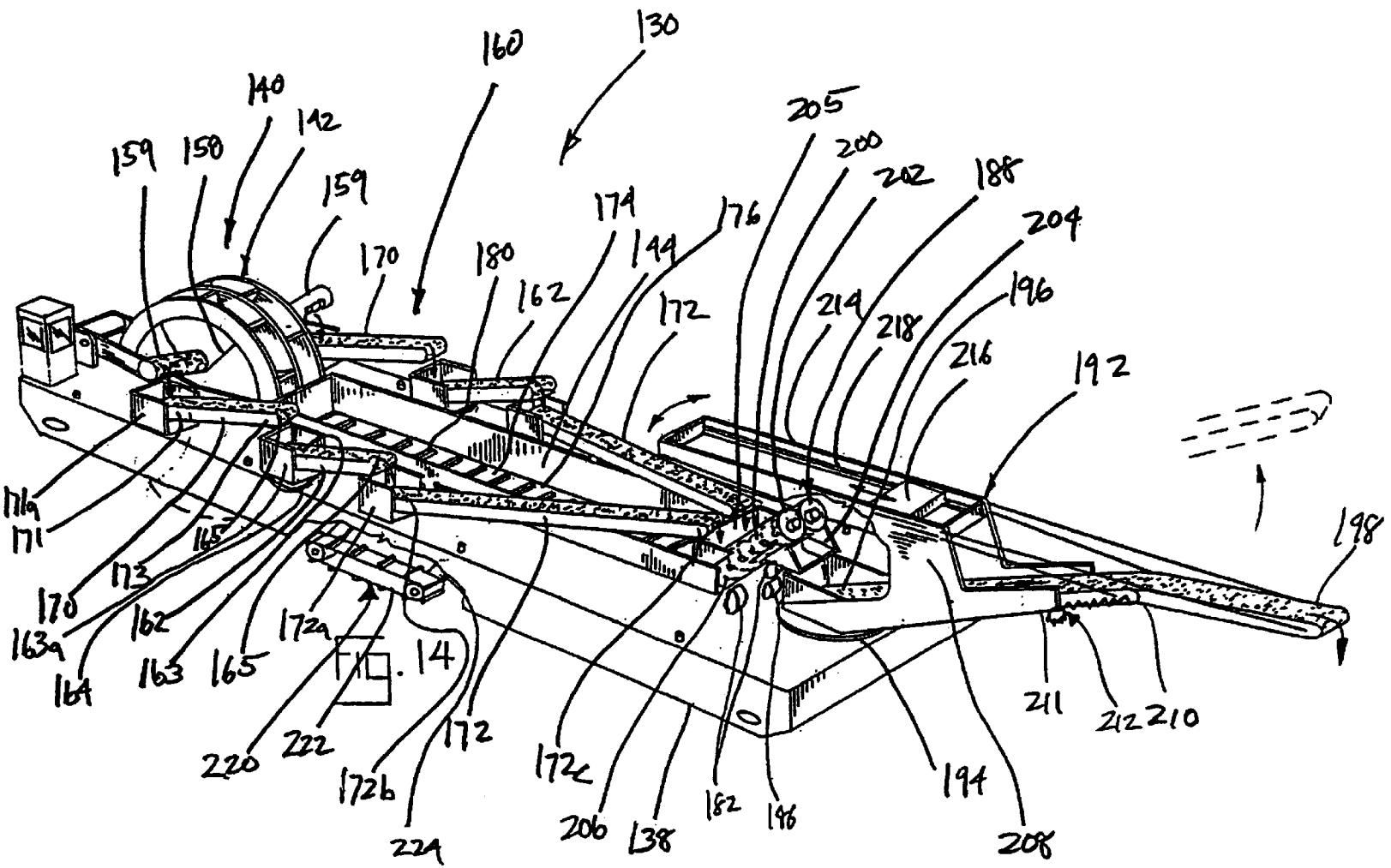
FIG. 14 is a perspective view of another multi-purpose vessel for use in a dredging operation which has been constructed in accordance with the teachings of the present invention, the vessel is shown in one possible state of operation in which recovered material is being conveyed directly toward a distribution conveyor for deposition therefrom at a desired location.

The hopper 144 includes a moveable floor 174 of the type described above with respect to the fit embodiment. The movable floor 174 preferably extends over substantially the entire length and width of the hopper 144 and supports the material recovered in the dredging operation within the hopper 144. The movable floor 174 is preferably implemented by an endless conveyor belt 176 mounted upon a plurality of idler rollers (not shown). As shown in FIG. 14, the belt 176 is also preferably provided with steel cleats 180 to reduce, and preferably prevent, slippage between the moving floor 174 and the recovered material the floor supports as the material is being conveyed or moved by the floor 174. The belt 176 is driven by a pair of ejection winches 182 and a retracting winch 186, so as to be capable of the dual mode operation described above.

Referring now to FIGS. 14–18, a distribution conveyor 192 is mounted to the hull 138 adjacent an end 193 of the hopper 144. The distribution conveyor 192 is preferably mounted to a turret 194 of conventional design, and is rotatable on the turret 194 by a rack and pinion assembly 195. The distribution conveyor 192 includes a first end 196 disposed in a receiving box 197, and further includes a second end 198. As shown to advantage in FIGS. 17–19, the second end 198 can be placed at a desired location a substantial distance away from the hull 138, and can further be rotated or slewed by operation of the turret 194.

Figure 17:
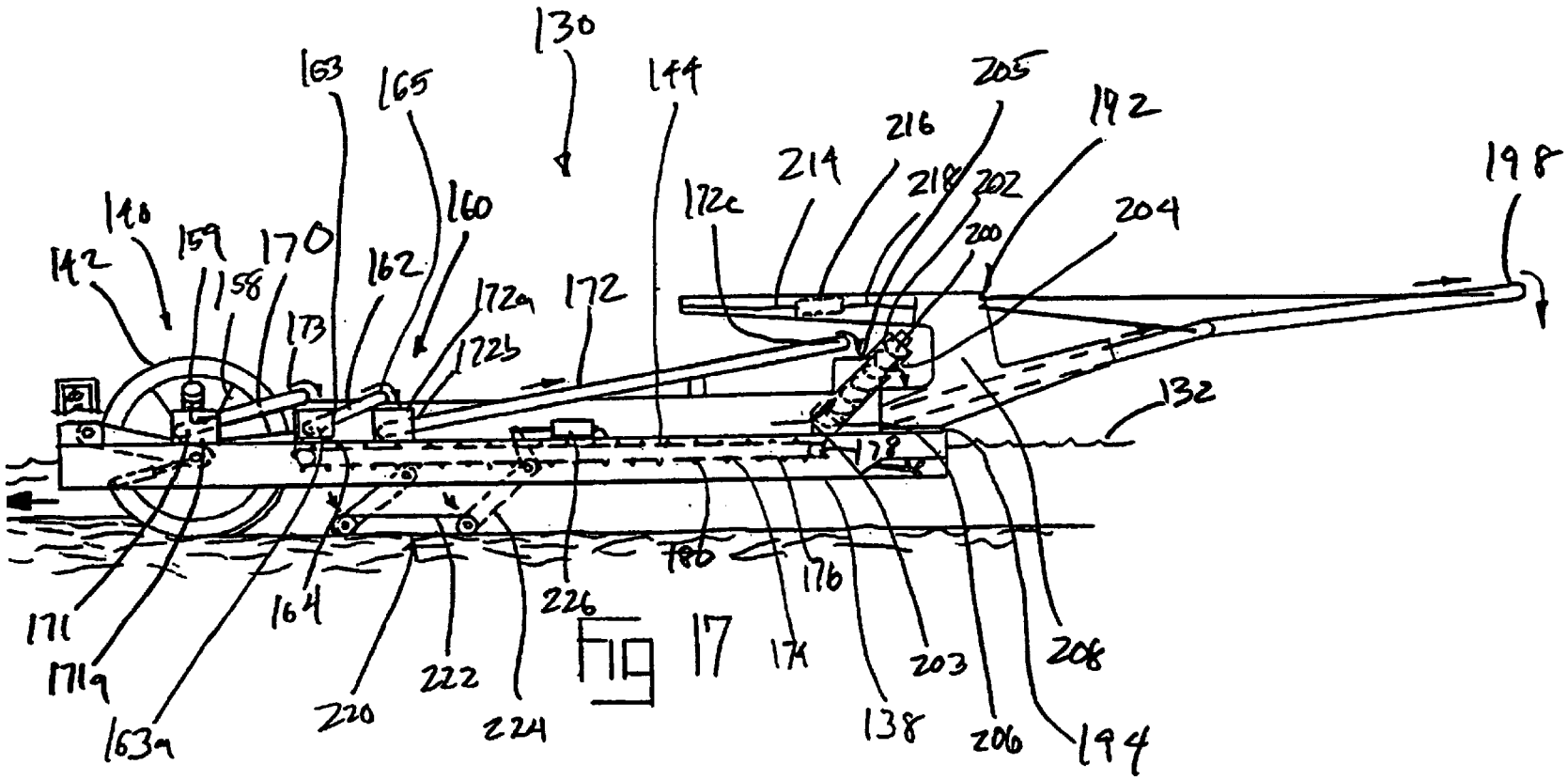
FIG. 17 is a side elevational view of the vessel of FIG. 14.
Figure 18:
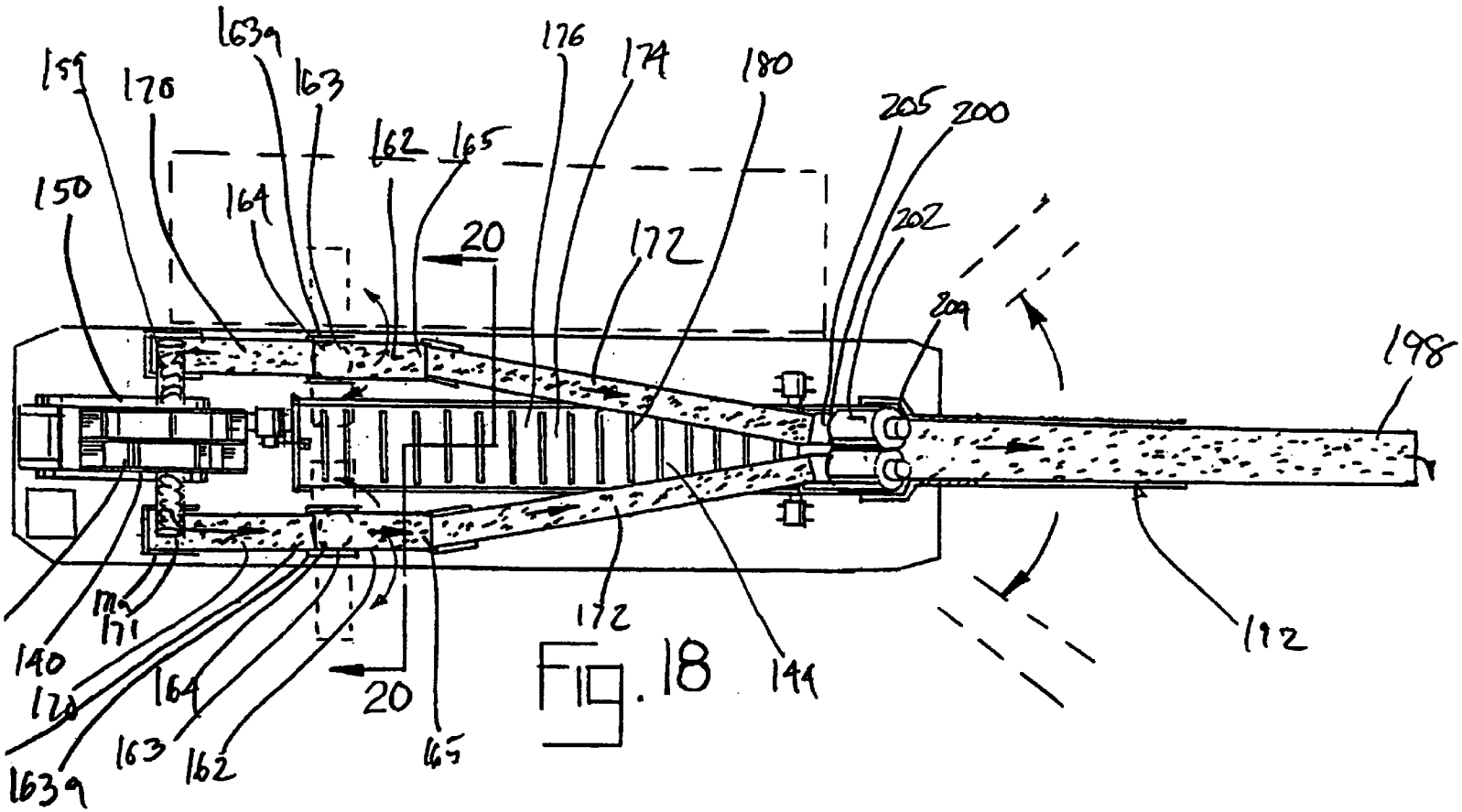
FIG. 18 is a top plan view thereof illustrating the manner by which portions of the conveyor system and the distribution conveyor may be rotated or slewed.

The discharge assembly 188 preferably includes a pair of counter-rotating augers 200, each of which is rotated by conventional electric or hydraulic motors as would be known. The augers 200 are disposed in a housing 202 having an ejection chute 104 generally adjacent to the receiving box 197. A bottom portion 206 of each auger 200 extends into the hopper 144, such that the material 136 may be extracted therefrom and conveyed through the housing 202 to the ejection chute 204, from where the material is conveyed to the first end 196 of the distribution conveyor 192 via the receiving box 197. As can be seen in FIG. 17, the housing 202 includes a lower inlet 203, through which material 136 may be drawn from the hopper 144, and further includes an upper inlet 205, through which material 136 may be received from the second end 172*c* of the conveyor 172. Material entering through either inlet 203 or 205 will be conveyed by the augers 200 to the discharge chute 204, for deposition onto the first end 96 of the distribution conveyor 192. The distribution conveyor 192 includes a flexible and rotatable belt and suitable drive motors, all of which are of conventional design and which are carried by a suitable support 208 mounted on the turret 194. The distance the material 136 is deposited away from the hull 138 may typically be controlled by slewing the distribution conveyor 192 on its turret 194.

As shown in FIG. 17, the distribution conveyor 192 may optionally be extensible, such as by slidably mounting an extensible portion 210 in a suitable housing 211 defined in the support 208. A rack and pinion assembly 212 may be provided for extending and retracting the extensible portion 210.

The distribution conveyor 192 includes a support 208 which includes an extending cantilevered portion 214. The cantilevered portion 214 includes a moveable counterweight 216 (FIGS. 14–16) which is slidably mounted in a track 218 defined in the cantilevered portion 214. The counterweight 216 is slidable within the track, such as by a rack and pinion arrangement or a winch and cable assembly (not shown), so as to counteract the significant weight of the material on the conveyor 192.

Figure 21:
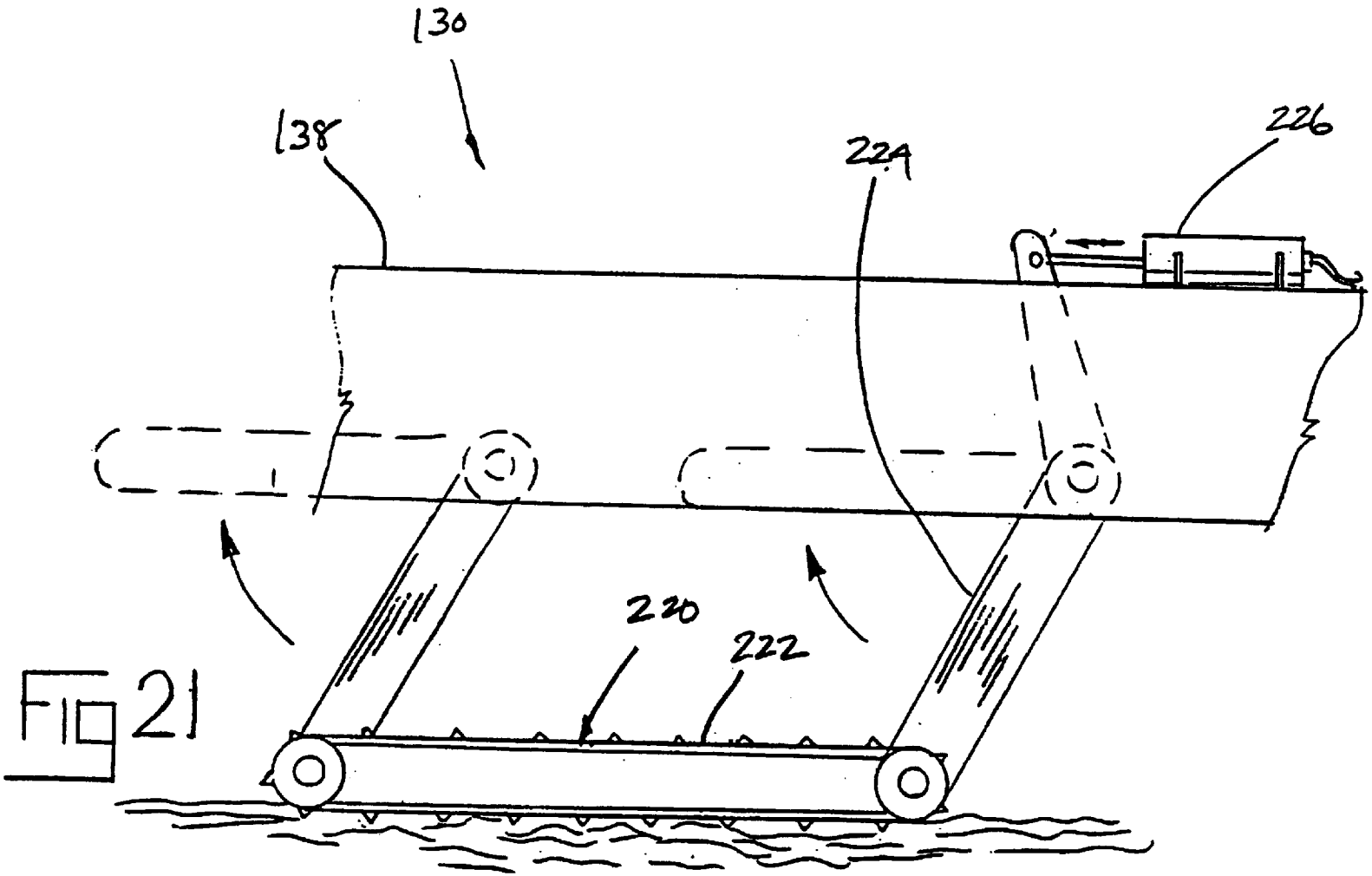
FIG. 21 is an enlarged fragmentary side elevational view of an alternate retractable tractive propulsion element constructed in accordance with the teachings of the present invention.

Referring now to FIGS. 14, 15, 17 and 19–21, a propulsion system 220 having a flexible tractive belt is mounted to the underside of the hull 138. Such a propulsion system 220 may be used in place of or in addition to a more traditional propulsion system (not shown) such as water jets or propeller drive systems. The propulsion system 220 includes a flexible, cleated track 222, and is mounted to a retractable linkage assembly 224 actuated by a hydraulic cylinder 226 (FIG. 21). The linkage assembly 224 permits the track 222 to be raised and lowered between the drive position of FIG. 21 and the retracted position shown in phantom in FIG. 21. The track 222 is preferably driven by hydraulic motors having suitably sealed operating systems. Such a flexible track 222 having a hydraulic drive system is manufactured by Caterpillar®.

In operation, the vessel 130 proceeds along under power in a direction generally to the upper left when viewing FIG. 14. As described above, the rotating dredge wheel 142 continually deposits recovered material 136 into the trough 158, from where the material 136 is extracted by the augers 159 and deposited into the receiving box 171*a* of the conveyor 170. The material is then conveyed from the first end 171 to the second end 173, from where it is deposited into the receiving box 163*a* of the transfer conveyor 162.

Figure 16:
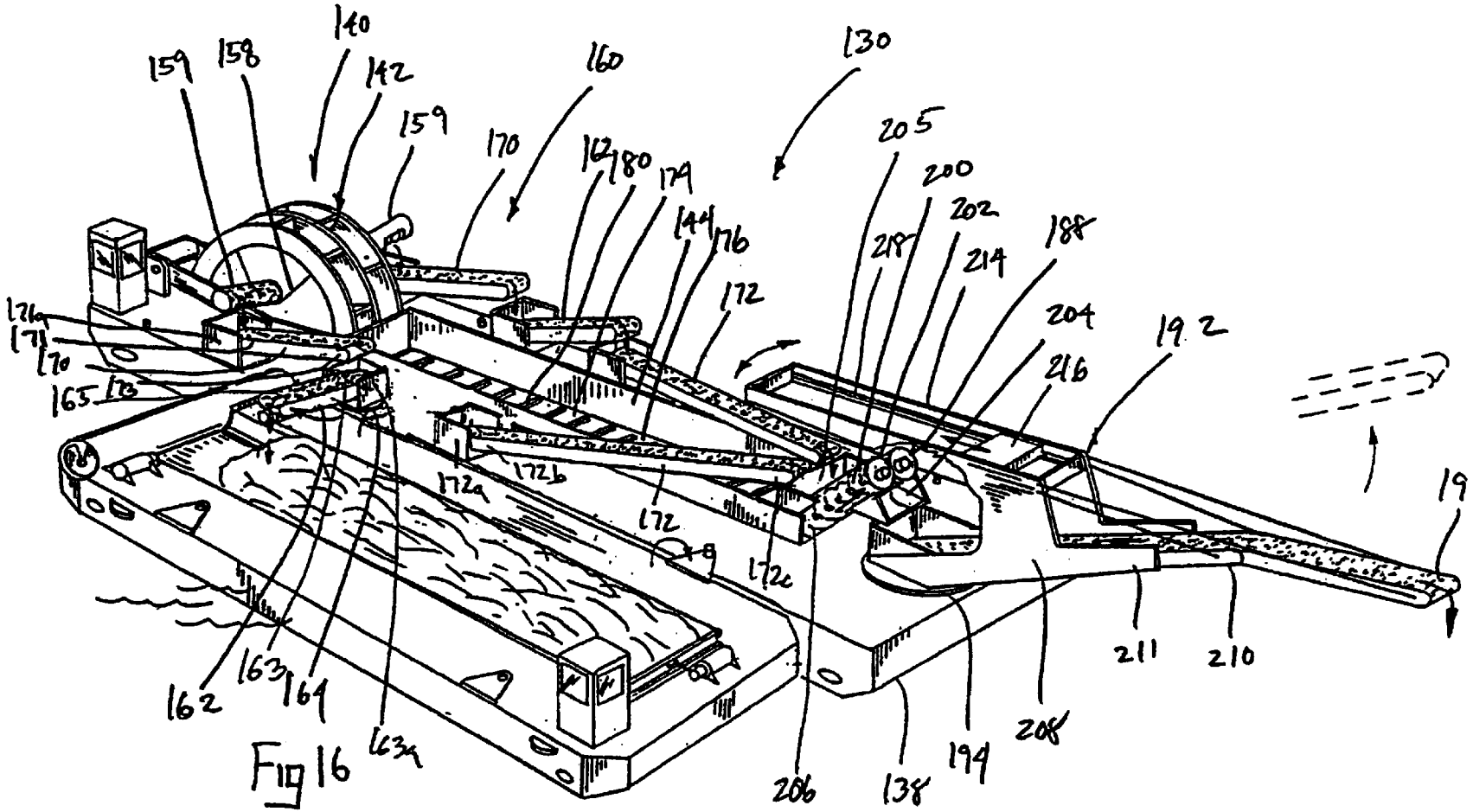
FIG. 16 is a perspective view of the vessel of FIG. 14, but shown in a third possible state of operation in which the recovered material is being directed toward a storage hopper.

The transfer conveyor 162 enables the conveyor system 160 to operate in a number of modes. One such mode is shown in FIG. 16, in which an adjacent transport vessel of the type described above is disposed alongside the vessel 130 and secured thereto by a suitable docking pins and capture arms of the type described more fully in the above-mentioned co-pending patent application Ser. No. 09/486,285. By operation of the rack and pinion assembly 168, the transfer conveyor 162 maybe rotated on its turret 164 such that the second end 165 is disposed over the hopper of the adjacent vessel. Accordingly, the material 136 recovered by the dredge wheel 142 may be deposited along a path directly into the adjacent vessel for transport.

Figure 15:
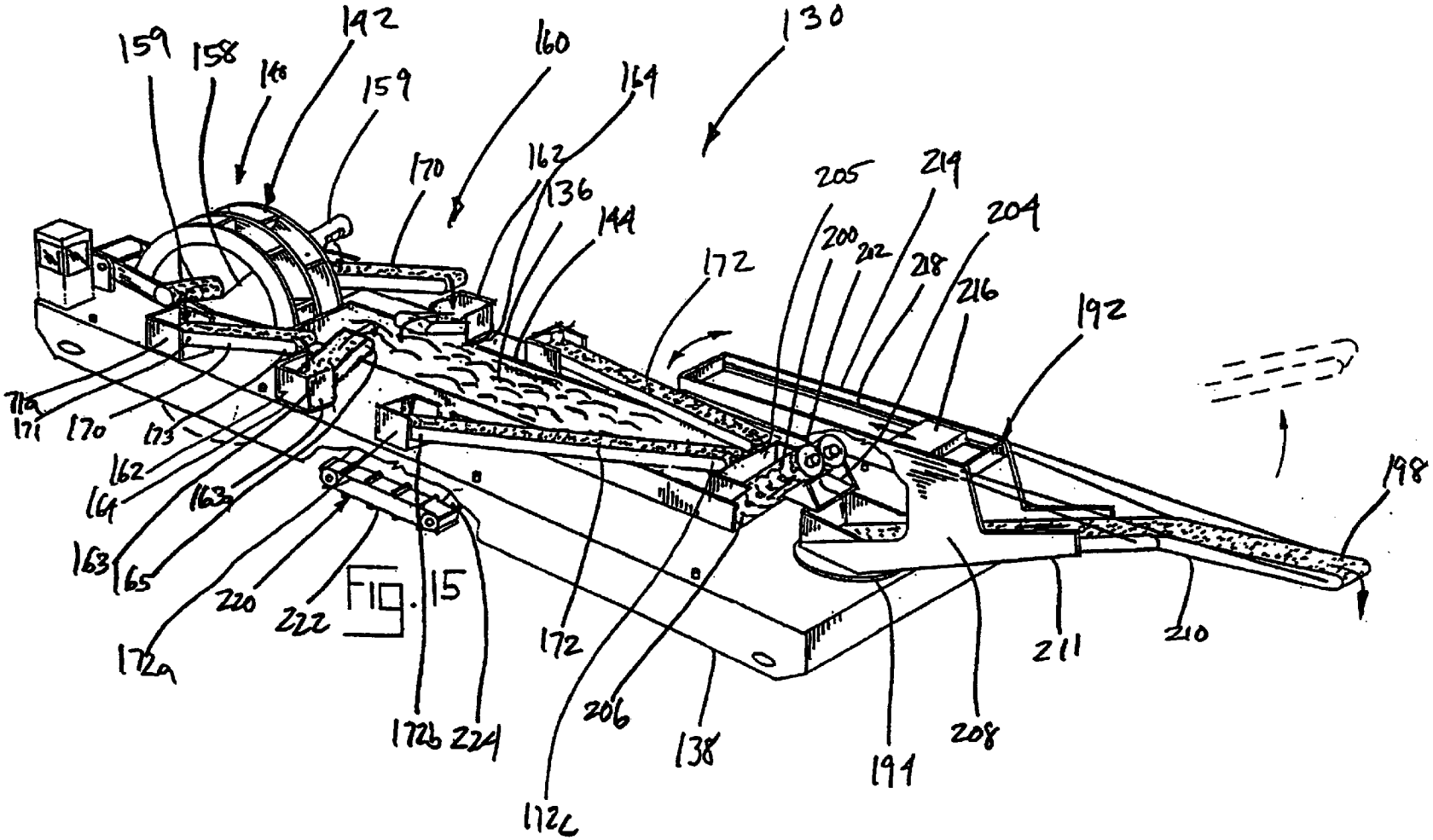
FIG. 15 is a perspective view of the vessel of FIG. 14, but shown in a second possible state of operation in which the recovered material is being conveyed to an adjacent transport vessel.

Another such operational mode is illustrated in FIG. 15, wherein the second end 165 of the conveyor 162 is positioned directly over the hopper 144 of the vessel 130. In this mode, the material may be directed along a path into the hopper 144. As the material 136 is deposited on the moveable floor 174, the winches 182 are activated such that the hopper 144 is gradually loaded as the moveable floor 174 carries the material 136 toward the discharge assembly 188. Further in this operational mode, once the hopper 144 is full it may be emptied by continuing to operate the winches 182. As the belt 176 proceeds as described above, the material 136 is conveyed toward the augers 200 of the discharge assembly 188, which augers 200 draw the material 136 from the hopper 144 through the lower inlet 203 and convey the material 136 to the receiving box 197 of the distribution conveyor 192 via the discharge chute 204. The material 136 is then conveyed along the distribution conveyor 192 to the second end 198 thereof, from where the material is deposited at a desired location.

It will be understood that the vessel 130 may also load an adjacent vessel simultaneously with loading its own hopper 144, simply by independently positioning the transfer conveyors 162 on both sides of the vessel as required. It will also be understood that the vessel 130 may load the hopper 144 until full, cease dredging operations, and then travel to a designated location to deposit the material 136 (such as at a levee to be constructed, at an island to be constructed, or at a designated truck loading station if it is desired to haul the material 136 away).

Figure 19:
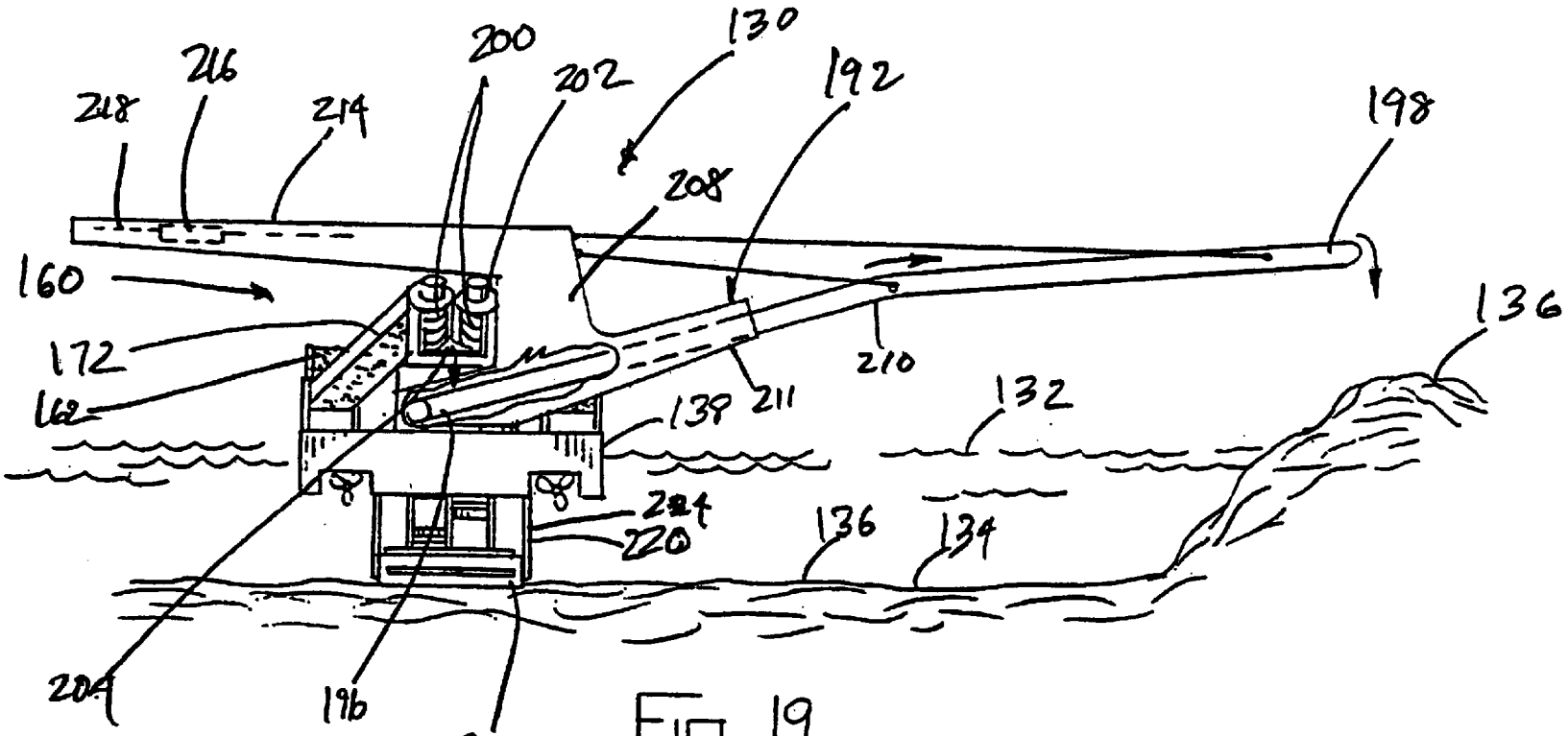
FIG. 19 is stern end elevational view of the vessel illustrating the manner by which the distribution conveyor may be slewed to deposit recovered material at a desired location away from the vessel.
Figure 20:
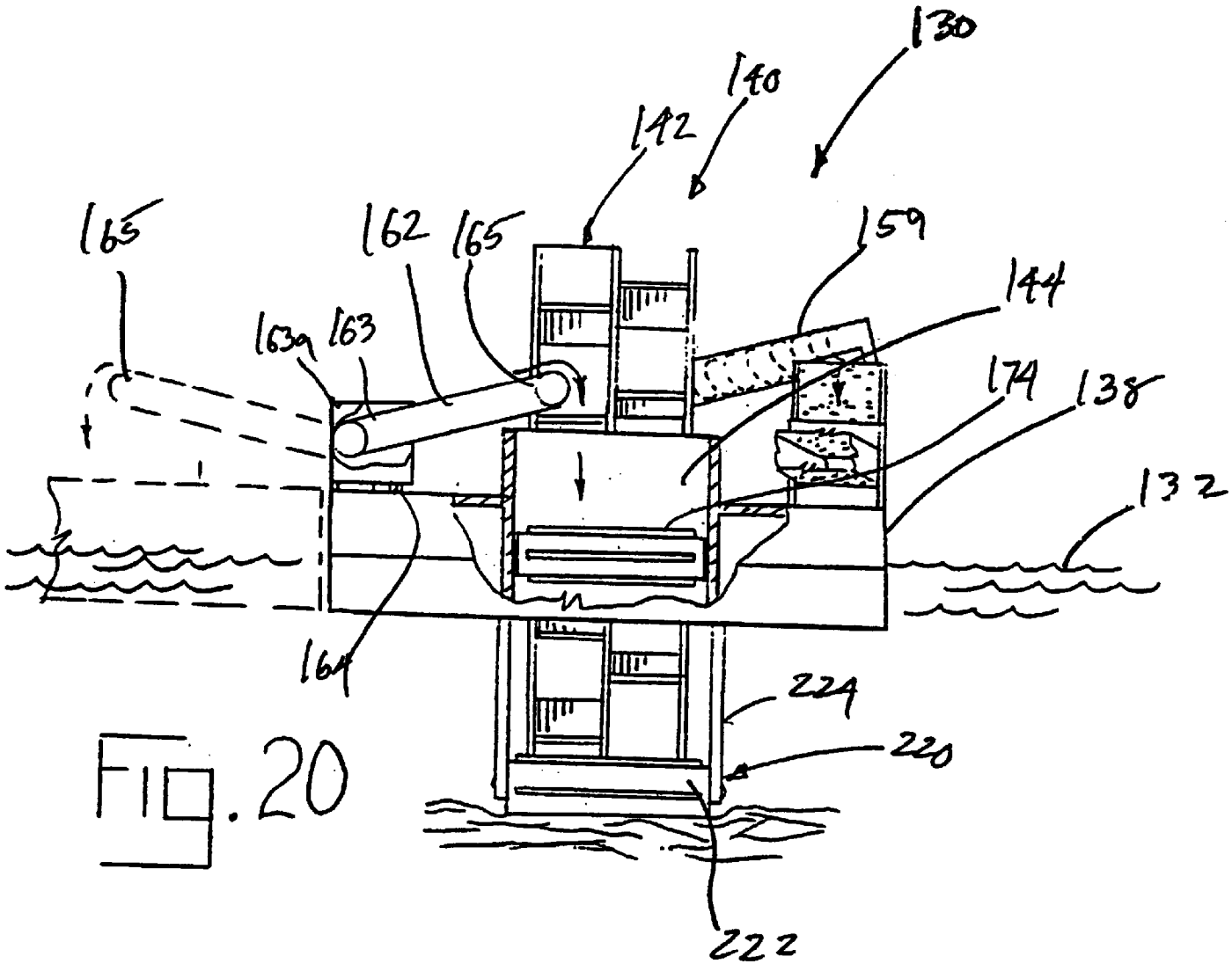
FIG. 20 is an enlarged fragmentary cross-sectional view taken along line 20—20 of FIG. 18.

Another possible mode of operation is illustrated in FIGS. 14 and 19. With the transfer conveyor 162 positioned as shown with the second end 165 disposed over the receiving box 172*a* of the conveyor 172, the material 136 may be routed directly and continuously to the distribution conveyor as the vessel 130 operates. As shown in FIG. 19, with the distribution conveyor 192 slewed by rotating the conveyor on its turret 194, the vessel may deposit the material on the riverbank, on a levee, or build an island as the vessel 130 continues through the waterway. In certain circumstances wherein there is not enough room in a channel top operate adjacent transport vessels, the vessel 130 can directly transport the material 136 sideways for deposit until a working channel has been created. Alternatively, the vessel 130 can create a levee as it travels through the waterway, and can even repair a breach in a levee as it travels by slewing, advancing, and/or retracting the conveyor 192 as required to continuously deposit material 136 at a designated location. Accordingly, the vessel 130 can operate quickly to construct a levy using on-site materials, namely, materials dredged from the bottom of a waterway threatening to flood. In view of the large volumes of material that can be recovered and deposited quickly by the vessel 130, levies can be constructed or repaired in a very short time frame to address a potentially dangerous situation. Again, other possible modes of operation, including operating in a number of modes simultaneously, will become readily apparent to those of skill in the art.

Although certain instantiations of the teachings of the invention have been described herein, the scope of coverage of this patent is not limited thereto. On the contrary, this patent covers all instantiations of the teachings of the invention fairly falling within the scope of the appended claims either literally or under the doctrine of equivalents.

What is claim:

1. A multi-purpose vessel for use when recovering material from a bottom surface of a body of water, the vessel comprising:

a hull;

a dredge assembly mounted to the hull, the dredge assembly being adapted to recover the material from the bottom surface;

a hopper supported by the hull, the hopper being adapted to receive the material and including a floor, at least a portion of the floor being moveable to permit movement of the material in the hopper; and a transfer conveyor mounted on the hull and being shiftable between a first position in which the transfer conveyor receives material from the dredge assembly and is operable to convey the material into the hopper, the transfer conveyor further being shiftable to a second position in which the transfer conveyor receives material from the dredge assembly and is operable to convey the material off the vessel.

2. A vessel as defined in claim 1, wherein the moveable floor includes a flexible belt mounted on a plurality of rollers.

3. A vessel as defined in claim 1, wherein the hopper includes a slat conveyor for moving the material in the hopper.

4. A vessel as defined in claim 1, wherein the distribution conveyor includes an extendable portion.

5. A vessel as defined in claim 4, wherein the extendable portion is slidably mounted in a housing, and including a rack and pinion assembly mounted to the housing and the extendable portion for extending and retracting the extendable portion.

6. A vessel as defined in claim 1, wherein the transfer conveyor comprises a rotatable belt, and wherein the transfer conveyor is moveably mounted to the hull.

7. A vessel as defined in claim 1, wherein the hopper is generally rectangular.

8. A vessel as defined in claim 1, further including a discharge auger mounted to the hull and having a portion extending into the hopper and arranged to cooperate with the moveable floor to discharge the material from the hopper.

9. A vessel as defined in claim 1, further including a discharge assembly mounted to the hull and having a portion extending into the hopper, the discharge assembly being adapted to discharge the material from the hopper.

10. A vessel as defined in claim 1, wherein the transfer conveyor is mounted on a turret assembly.

11. A vessel as defined in claim 10, including a rack and pinion arranged to rotate the transfer conveyor on the turret assembly.

12. A vessel as defined in claim 1, including a distribution conveyor comprising a rotatable belt conveyor, the distribution conveyor moveably mounted to the hull and having a first end and a second end, and further including a discharge conveyor having a portion extending into the hopper and being adapted to discharge the material from the hopper to the distribution conveyor adjacent the first end of the distribution conveyor, the second end of the distribution conveyor being moveable to a desired position to thereby unload the material at a desired location.

13. A vessel as defined in claim 12, wherein the distribution conveyor includes a moveable counterweight, the counterweight being positionable relative to the distribution conveyor so as to counteract the forces applied to the distribution conveyor by the material.

14. A vessel as defined in claim 12, wherein the distribution conveyor is mounted on a turret assembly.

15. A vessel as defined in claim 14, including a rack and pinion arranged to rotate the distribution conveyor on the turret assembly.

16. A vessel as defined in claim 1, wherein the discharge assembly includes a pair of counter rotating augers, each of the augers including a portion extending into the hopper.

17. A vessel as defined in claim 1, including a propulsion system for moving the hull through the water.

18. A vessel as defined in claim 17, wherein the propulsion system includes a plurality of positioning jets.

19. A multi-purpose vessel for use when recovering material from a bottom surface of a body of water, the vessel comprising:

a hull;

a nonsuction-based dredge assembly mounted to the hull, the dredge assembly being adapted to recover the material from the bottom surface;

a conveyor system, the conveyor system including a first portion adapted to receive the material from the dredge assembly, a moveable second portion, and a distribution conveyor, the second portion being moveable to a first position in which the second portion is adapted to receive the material from the first portion and to convey the material to a first desired location disposed a first distance away from the hull, the second portion further being moveable to a second position in which the second portion is adapted to receive the material from the first portion and to convey the material to the distribution conveyor, the distribution conveyor being adapted to convey the material a second distance greater than the first distance away from the hull.

20. The vessel as defined in claim 19, wherein the distribution conveyor includes a moveable counterweight, the counterweight being positionable on the distribution conveyor so as to counteract the forces applied to the distribution conveyor by the material traveling therealong.

21. A vessel as defined in claim 19, further including a hopper adapted to receive the material, and wherein the second portion is further adapted to convey the material to the hopper.

22. A vessel as defined in claim 21, wherein the hopper includes a moveable floor adapted to move the material in the hopper toward the distribution conveyor, and including an auger assembly having a portion extending into the hopper, the auger assembly being adapted to convey the material from the hopper to the distribution conveyor.

23. A vessel as defined on claim 22, wherein the moveable floor includes a flexible belt mounted on a plurality of rollers.

24. A vessel as defined in claim 21, and including a hopper adapted to receive the material, and further including an auger assembly positioned to receive the material from at least one of the conveyor second portion and the hopper, the auger assembly being adapted to convey the material to the distribution conveyor.

25. The vessel as defined in claim 24, wherein the auger assembly is disposed in a housing, the housing including a first feed port positioned to receive material from the conveyor second portion and further including a second feed port positioned to receive material from the hopper.

26. The vessel as defined in claim 24, wherein the auger assembly includes a pair of counter-rotating augers.

27. A multi-purpose vessel for use on a body of water, the vessel comprising:

a hull;

a dredge assembly mounted to the hull, the dredge assembly being a adapted to recover material from a bottom surface of the body of water;

a hopper supported by the hull, the hopper being adapted to receive the material, the hopper including a floor conveyor routed over a series of rollers, the floor conveyor operable to shift the material from a first part of the hopper to a second part of the hopper; and a conveyor system, the conveyor system including a first portion adapted to receive the material from the dredge assembly, the conveyor system further including a moveable second portion adapted to receive the material from the first portion and to convey the material along a plurality of desired paths, a first of the desired paths being away from the hull and a second of the desired paths being into the hopper and a distribution conveyor, the distribution conveyor arranged to receive the material from a selected one of the floor conveyor or from the conveyor system, the distribution conveyor moveably mounted to the hull and having a first end and a second end, the distribution conveyor defining a third desired path wherein the material may be deposited at a location remote from the hull.

28. The vessel as defined in claim 27, wherein the hull includes a docking mechanism adapted to secure an adjacent boat to the hull, and further wherein the first desired path is onto the adjacent boat.

29. The vessel as defined in claim 27, wherein the distribution assembly includes a distribution conveyor moveably mounted to the hull and having a first end and a second end, the distribution conveyor defining a third desired path wherein the material may be deposited at a location remote from the hull, the distribution assembly further including a moveable counterweight, the counterweight being positionable on the distribution assembly so as to counteract the forces applied to the distribution conveyor by the material traveling along the third desired path.

30. A vessel as defined in claim 29, wherein the distribution conveyor includes an extendable portion.

31. A vessel as defined in claim 30, wherein the extendable portion is slidably mounted in a housing, and including a rack and pinion assembly mounted to the housing and the extendable portion for extending and retracting the extendable portion.

* * * * *